US006974365B2

(12) United States Patent
Gurka

(10) Patent No.: US 6,974,365 B2
(45) Date of Patent: Dec. 13, 2005

(54) MACHINE AND METHOD FOR MACHINING WORKPIECES OF WOOD, PLASTIC MATERIAL OR THE LIKE

(75) Inventor: Paul Gurka, Waldbrunn (DE)

(73) Assignee: Michael Weinig Aktiengesellschaft, Tauberbischofsheim (DE)

( * ) Notice: Subject to any disclaimer, the term of this patent is extended or adjusted under 35 U.S.C. 154(b) by 476 days.

(21) Appl. No.: 10/064,647

(22) Filed: Aug. 2, 2002

(65) Prior Publication Data

US 2003/0024363 A1 Feb. 6, 2003

(30) Foreign Application Priority Data

Aug. 2, 2001 (DE) ..... 101 37 839

(51) Int. Cl.[7] ..... B24B 1/00

(52) U.S. Cl. ..... 451/28; 451/28; 451/57; 451/364; 451/365; 451/403

(58) Field of Search ..... 451/28, 57, 364, 451/365, 403

(56) References Cited

U.S. PATENT DOCUMENTS 4,694,871 A * 9/1987 Jenkner ..... 144/35.1

6,170,639 B1 * 1/2001 Diederich ..... 198/461.2

FOREIGN PATENT DOCUMENTS

DE 43 01 217 7/1994

* cited by examiner

*Primary Examiner*—Joseph J. Hail, III
*Assistant Examiner*—Shantese McDonald
(74) *Attorney, Agent, or Firm*—Gudrun E. Huckett

(57) ABSTRACT

A machine for machining workpieces of wood or plastic material has at least one longitudinal profiling unit with at least one longitudinal profiling spindle. At least one advancing unit is provided for moving a workpiece past the at least one longitudinal profiling unit. The advancing unit has upper clamping jaws arranged above the workpiece and lower clamping jaws arranged below the workpiece such that at least some of the upper clamping jaws are staggered relative to the lower clamping jaws, when viewed in a plan view onto the advancing unit. A small free space is provided between the upper and lower clamping jaws, when viewed in a plan view. During transfer between the machining processes, the workpieces remain clamped at all times so that precise machining is ensured.

56 Claims, 15 Drawing Sheets

MACHINE AND METHOD FOR MACHINING WORKPIECES OF WOOD, PLASTIC MATERIAL OR THE LIKE

BACKGROUND OF INVENTION

1. Field of the Invention

The invention relates to a machine for machining workpieces of wood, plastic material or the like, comprising at least one longitudinal profiling unit which has at least one longitudinal profiling spindle, past which the workpiece can be moved by means of at least one advancing unit and which has clamping jaws. The invention also relates to a method for machining such workpieces, wherein the workpieces are clamped in at least one advancing unit and transported together with it through the machine.

2. Description of the Related Art

With such machines workpieces are machined from which window and door frames as well as wings of windows are produced. In the longitudinal profiling unit the workpieces are profiled along their longitudinal sides. For transporting the workpieces through the longitudinal profiling unit, advancing rollers are provided which are suspended from a support and rotatably driven. These advancing rollers press onto the workpieces which are supported on tabletops on which they are transported through the machine by means of the advancing rollers. The advancing rollers are subject to wear and soiling so that the transport of the workpieces is impaired. Moreover, the transport of short workpieces presents problems.

SUMMARY OF INVENTION

It is an object of the present invention to configure the machine of the aforementioned kind and the method of the aforementioned kind such that a reliable and simple transport through the machine as well as an exact positioning of the workpieces is ensured.

This object is solved by the invention for the machine of the aforementioned kind in that the clamping jaws are arranged above and below the workpiece such that at least some of the upper clamping jaws are staggered relative to the lower clamping jaws, when viewed in a plan view onto the advancing unit, wherein between the individual clamping jaws a small free space is provided, when viewed in a plan view. This is object is moreover solved for the method of the aforementioned kind in that the workpieces are clamped from above and below in the advancing unit and are transferred between different machining actions, wherein the workpieces always remain clamped during transfer.

In the machine according to the invention the advancing unit in the longitudinal profiling unit is in the form of a clamping unit with which the workpieces to be machined are not only clamped but also transported through the longitudinal profiling unit. Because of the advancing unit according to the invention, advancing rollers are no longer required in the longitudinal profiling unit. The workpieces to be machined are reliably engaged by the clamping unit and transported together with it through the machine. Slip problems, as they can be observed for advancing rollers, do not occur. By employing the clamping unit the top sides of the workpieces are treated gently which results in an excellent machining quality. It is also possible to clamp and machine very short workpieces by means of the clamping unit. Since the clamping unit is moved in the longitudinal profiling unit, it is possible to follow, measure, and position each workpiece very precisely by means of the axes of the machine. In this connection, limit switches, used in conventional machines, are no longer needed. The clamping jaws are arranged above and below the workpiece so that the workpiece is clamped from above and below. In this way, the workpiece can be machined without problems on its longitudinal sides with corresponding tools. The upper and lower clamping jaws are arranged such that, in a plan view, they are staggered relative to one another and have a small free space between them. With such a configuration of the clamping unit the workpieces can be clamped universally, flexibly, and reliably. In this way, the workpieces, in particular, also thin and short workpieces, can be machined in the clamped position with extreme precision and quality. When the workpieces are transferred between individual machining processes, they always remain clamped during transfer so that an extremely precise machining is ensured.

DETAILED DESCRIPTION

Figure 1:
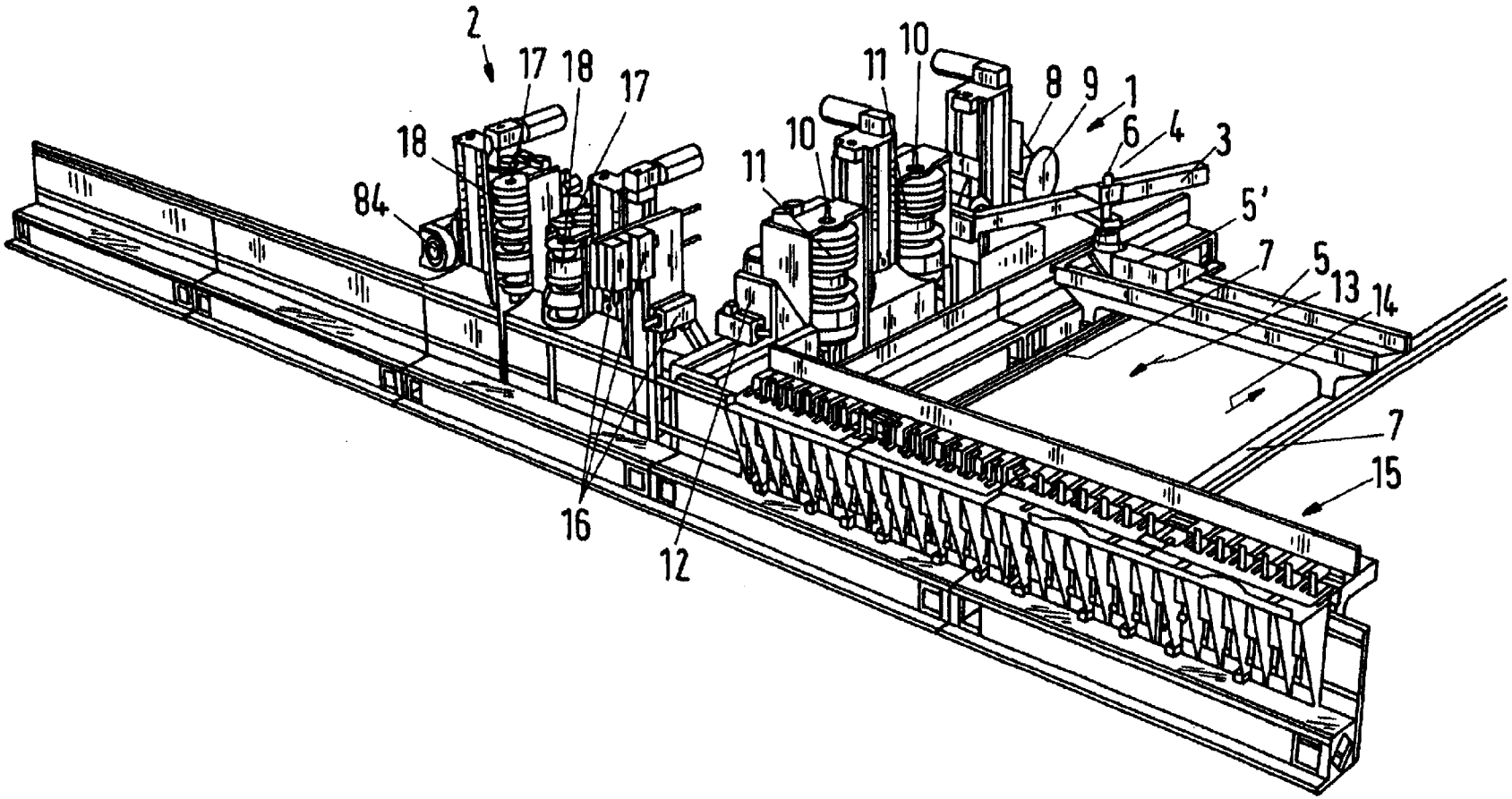
FIG. 1 is a perspective illustration of a machine according to the invention.

The machine described in the following is used for machining wooden articles used, for example, for assembling window or door frames or wings. However, the machine can also be used for machining wooden articles which are used for stair steps, furniture parts in frame construction or case construction or the like. The machine according to FIG. 1 has a transverse profiling unit 1 and a longitudinal profiling unit 2 positioned at a right angle to the unit 1. With the transverse profiling unit 1 the wooden articles 3 are machined at their end faces. In the longitudinal profiling unit 2 the wooden articles are subsequently profiled along their longitudinal sides.

The wooden articles 3 to be machined are clamped in a predetermined position, preferably centrally, in the transverse profiling unit 1 by means of a clamping device 4 which is pivotable on the carriage 5' about a vertical axis 6. The carriage 5' can be moved along a transverse carriage 5 which is movable along a guide 7. Both carriages 5, 5' are adjustable relative to one another in perpendicular directions.

The transverse profiling unit is provided with at least one saw 8 with which the respective end of the wooden article 3 can be cut off. Depending on the position of the wooden article 3 relative to the saw 8, the end faces of the wooden article 3 can be sawed perpendicularly but also at an acute angle or obtuse angle to the longitudinal direction of the wooden articles. In this case, the wooden article 3 is pivoted by means of the clamping device 4 about the axis 6 by the desired angle. For this purpose, a motor drive (not illustrated) is provided with which the clamping device 4 can be automatically pivoted into the desired position. Advantageously, the clamping device 4 is connected to a CNC control.

The saw 8 has a circular saw blade 9 which is driven in rotation about a horizontal axis. Downstream of the saw 8 the transverse profiling unit 1 is provided with at least one vertical spindle 10 on which, as is known in the art, a tenon/mortise tool 11 is fixedly seated. By means of this tool, the previously sawed end of the wooden article 3 is profiled in the transverse direction, for example, by providing a tenon or a mortise or a counter profile. The spindle 10 with the tool 11 can be adjusted in the axial direction as is known in the art. In this case, two or more tools are seated on the spindle 10 above one another with which the ends of the wooden article 3 can be machined in the desired way. Moreover, the spindle 10 can also be radially adjustable in order to be able to adjust the spindle 10 to the different diameters of the respective tool 11. The transverse profiling unit 1, as shown in the illustrated embodiment, can be provided with a second spindle 10 for an additional tool 11. This second spindle 10 is retracted and thus not in use. Instead of retracting this spindle 10, the clamping device 4 can also be retracted by means of the carriage 5' on the transverse carriage 5.

Downstream of the spindle 10, the transverse profiling unit 1 is provided with at least one drilling and/or doweling unit 12. By means of this unit, the wooden article 3 can be provided with at least one bore and/or with at least one dowel subsequent to the transverse profiling process.

The transverse profiling unit 1 can also have only the saw 8 and/or the spindle 10 and/or the unit 12.

Figure 2:
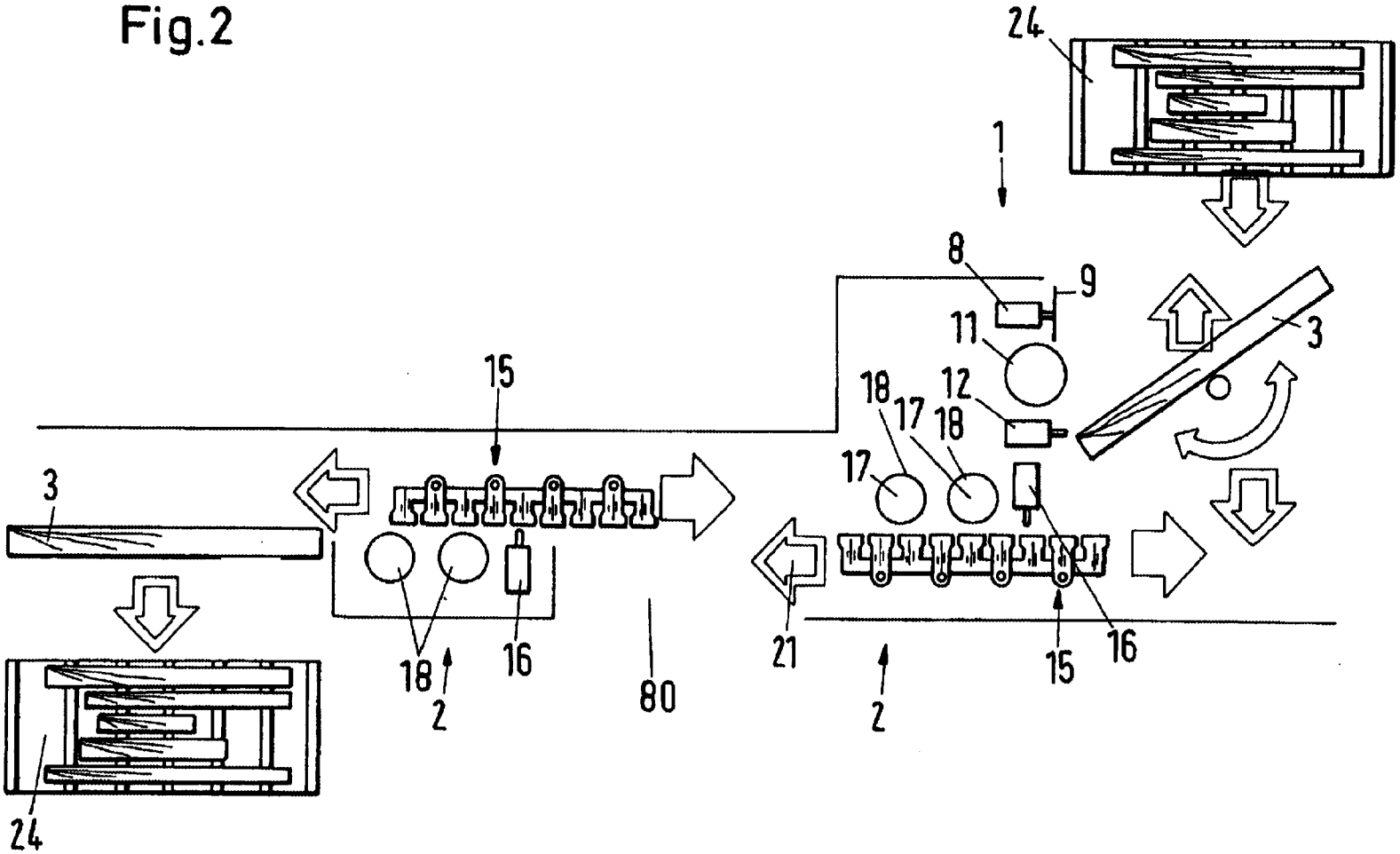
FIG. 2 shows in a plan view and in a schematic illustration the process sequence for machining wooden articles in a first embodiment of the machine according to the invention.

The transverse carriage 5 is moved from the initial position illustrated in FIG. 1 along the guide 7 in the direction of arrow 13. When doing so, the clamped wooden article 3 is sequentially first cut by the saw 8 at its ends, subsequently transversely profiled and drilled and/or provided with a dowel. Depending on the configuration of the machine, the transverse carriage 5 can be returned in the transport direction 14 into its initial position and the clamping device 4 can be pivoted about the vertical axis 6 such that, with a new pass of the wooden article 3 through the transverse profiling unit 1, the other end of the wooden article 3 is sawed and transversely profiled. In this case, the wooden article 3 is first machined on both ends before it is transferred to the longitudinal profiling unit 2. Such a process sequence is illustrated in FIG. 2. The wooden article 3 is transported in the described way twice through the transverse profiling unit 1 and accordingly machined on both ends. Subsequently, the wooden article 3, machined on both ends, is transferred to the longitudinal profiling unit 2 in which the wooden article 3 is longitudinally profiled in a way to be described in the following.

When the transverse carriage 5 has reached the transfer location, the clamping device 4 is rotated such that the wooden article is positioned parallel to the transport direction in the longitudinal profiling unit 2. In this position, the wooden article can be received by an advancing unit 15 of the longitudinal profiling unit 2. The wooden article 3 is transported by it in its longitudinal direction through the longitudinal profiling unit and is machined during this pass on the corresponding longitudinal side. In the machine according to FIG. 1, the longitudinal profiling unit 2, viewed in the transport direction of the wooden article 3, is provided first with drilling units 16 and at least one vertical spindle 17 on which at least one longitudinal profiling tool 18 is fixedly seated. In the illustrated embodiment, the longitudinal profiling unit 2 is provided with two spindles 17 on which at least one longitudinal profiling tool 18 is seated, respectively. By means of the drilling units 16, bores are machined in the longitudinal side, which is positioned to the right in the transport direction, as well as in the top and/or bottom side of the wooden article 3. The longitudinal profiling tool 18 profiles the right longitudinal side of the wooden article 3 in the transport direction. The longitudinal profiling unit 2 can be provided with additional spindles. FIG. 1 shows in an exemplary fashion a horizontal mortise spindle 84 behind the second longitudinal profiling spindle 17.

FIG. 2 shows a first embodiment of the machine in which the wooden article 3, as described above, is machined sequentially on both ends in the transverse profiling unit 1 by passing through it twice. Subsequently, the wooden article 3 is transferred to the advancing unit 15 which moves the wooden article past the drilling units 16 as well as the two longitudinal profiling tools 18 of the longitudinal profiling unit 2. The longitudinal profiling tools 18 and the drilling units 16 are arranged such that the wooden article 3, when passing through, is machined on its right longitudinal side, as described above. Downstream of the longitudinal profiling tools 18, the machine is provided with a second longitudinal profiling unit 2 with further longitudinal profiling tools 18 as well as additional drilling units 16. They are arranged such that, when passing through, the wooden article 3 is machined on the left longitudinal side. In this way, only a single pass of the wooden article 3 through the longitudinal profiling unit 2, and thus through the entire machine, is required. After machining both longitudinal sides, the wooden article 3 is supplied by means of a transporting unit perpendicularly to the transport direction 21 within the longitudinal profiling units 2 to a further station or an additional magazine 24. This machine represents a continuous apparatus in which the wooden articles 3 are machined continuously when passing through the machine. The wooden article 3 during the entire machining process and at any time is fixedly clamped in the transverse as well as in the longitudinal profiling units 1, 2 so that an optimal machining quality and machining precision can be achieved.

Figure 3:
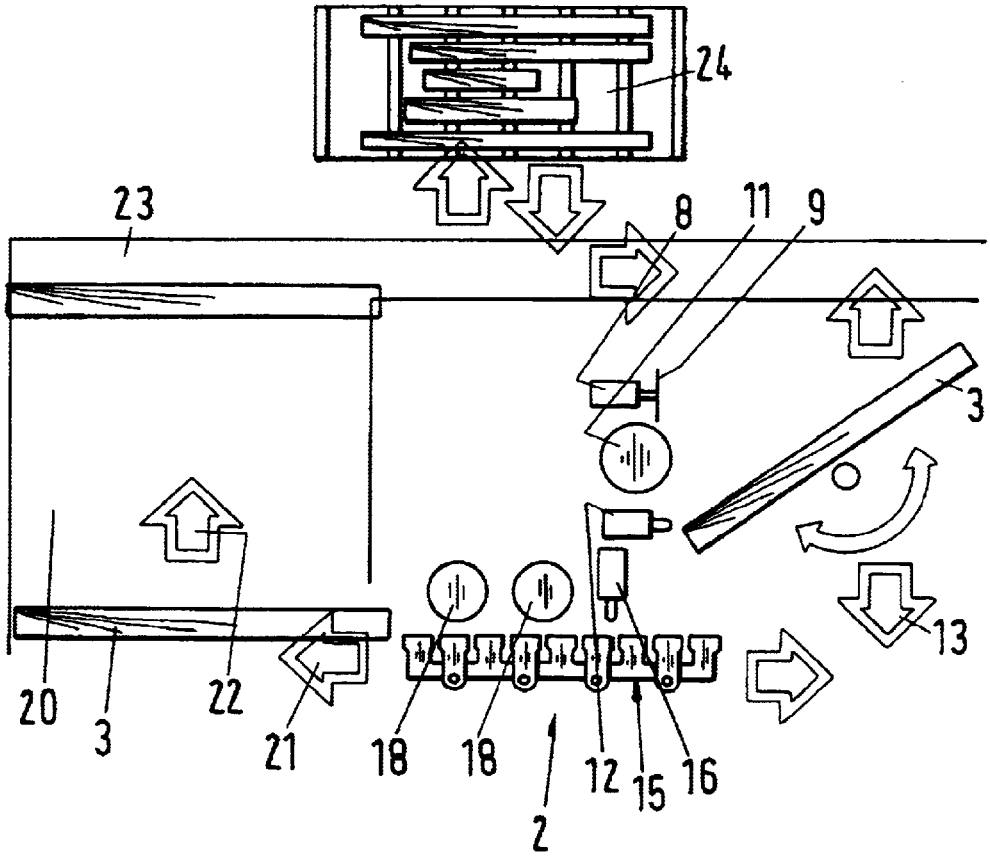
FIG. 3 shows in an illustration corresponding to FIG. 2 the process sequence for machining wooden articles in a second embodiment of the machine according to the invention.

In a second embodiment of the machine according to FIG. 3, the wooden article 3 after passing through the longitudinal profiling unit 2 is moved onto a transverse conveyor 20 with which the wooden article is transported back to the transverse profiling unit 1. Two different machining operations of such a machine will be explained in more detail with the aid of FIG. 3. According to the first machining sequence, the wooden article 3 is first transported in the transport direction 13 in the transverse profiling unit 1 in the way described above. By means of the circular saw blade 9 of the circular saw 8, the corresponding end of the wooden article 3 is sawed off and is transversely profiled with the downstream tool 11, for example, by providing a mortise or tenon. Subsequently, by means of the drilling and/or doweling unit 12 the wooden article 3 is drilled and/or doweled. Subsequently, the wooden article 3 is transferred to the advancing unit 15 of the longitudinal profiling unit 2. In the longitudinal profiling unit the wooden article 3 is drilled with the drilling units 16 on its longitudinal side as well as its top and/or bottom side. Subsequently, the longitudinal side is longitudinally profiled with at least one of the two longitudinal profiling tools 18 positioned at a spacing sequentially behind one another. The wooden article 3 which has been machined on one end and one longitudinal side then reaches the transverse conveyor 20 with which the wooden article is transported, perpendicularly to the transport direction 21, in the transport direction 22 within the longitudinal profiling unit 2. The transverse conveyor 20 transfers the wooden article 3 to a transport unit 23 which is positioned parallel to the advancing unit 15 and which conveys the wooden article 3 back to the transverse profiling unit 1. Here, the wooden article 3 is then received by the clamping device 4 and aligned such that the other end of the wooden article 3, which is not yet machined, is cut off by the saw 8, then transversely profiled by the tool 11, for example, mortised or tenoned, and optionally machined by the drilling and/or doweling unit 12. The wooden article 3, which now has been machined on both ends, is then transferred to the advancing unit 15 of the longitudinal profiling unit 2 so that the longitudinal side of the wooden article 3 which has not yet been machined passes the drilling units 16 and the two longitudinal profiling tools 18. By means of the drilling units 16, if needed, this longitudinal side of the wooden article 3 is drilled. The wooden article 3 is then longitudinally profiled by the downstream tools 18 which are rotatable about vertical axes.

In the second preferred machining operation in the transverse profiling unit 1 first both ends of the wooden article 3 are machined wherein the transverse carriage 5 moves in the described way twice through the transverse profiling unit 1. Then the wooden article 3, which has been machined on both ends, is transferred to the advancing unit 15 which is in the transfer position illustrated in FIG. 1. The wooden article 3 is then moved by the advancing unit 15 past the drilling units 16 and the longitudinal profiling tools 14 and machined on its longitudinal side. By means of the transverse conveyor 20 and the transport device 23 the wooden article 3 is returned to the transverse profiling unit 1 and received by the clamping device 4. With the transverse carriage 5 the wooden article 3 is transported without machining through the transverse profiling unit 1 and transferred to the advancing unit 15 such that the wooden article 3 upon transport through the longitudinal profiling unit is machined on the other longitudinal side.

While the wooden article is transported by the transverse conveyor 20 to the transporting unit 23, the advancing unit 15 is returned into the transfer position so that it can instantly take over this wooden article.

The machine according to FIG. 3 represents a circular device in which the wooden article is transported twice through the machine. After the wooden article 3 has passed twice through the machine, the finish-machined wooden article is either moved past the transverse conveyor 20 to further machining; however, it is also possible to transfer the finish-machined wooden article 3 to the transverse conveyor 20 which transfers the finish-machined wooden article 3 to the transport device 23 which deposits the wooden article in a magazine 24 (FIG. 3).

Figure 7:
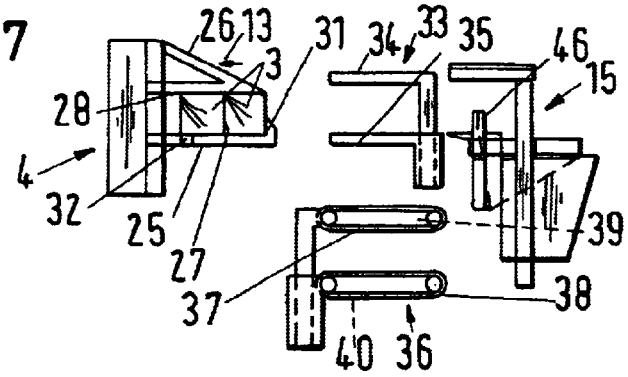
FIG. 7 illustrates the first step of a process sequence for transferring the workpieces to be machined from a first advancing unit to a second advancing unit.
Figure 8:
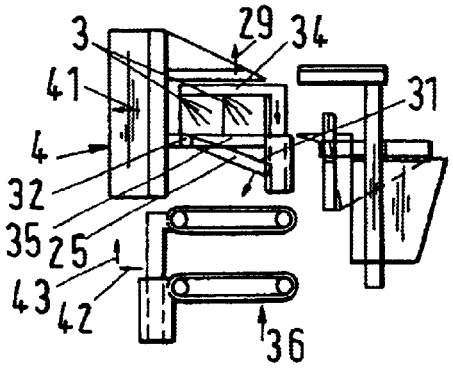
FIG. 8 illustrates the second step of a process sequence for transferring the workpieces to be machined from a first advancing unit to a second advancing unit.

As is illustrated in FIGS. 7 through 11, two wooden articles can be simultaneously machined in the transverse profiling unit 1. The wooden articles 3 are positioned with their longitudinal sides abutting one another and are clamped in the clamping device 4. The clamping device 4 is embodied as a vise-grip clamping device and has a lower clamping jaw 25 and an upper clamping jaw 26. The wooden articles 3 are clamped between the two clamping jaws 25, 26. The clamping jaws 25, 26 have planar support surfaces 27, 28 so that the wooden articles can be reliably clamped. The upper clamping jaw 26 is adjustable in the vertical direction 29 (FIG. 8). The entire clamping device 4 is adjustable transverse to the axis of the wooden articles 3 in the direction of arrow 13, as described above.

The lower clamping jaw 25 is provided at its free end with an upwardly extending stop 31 which prevents slipping of the wooden articles 3 transverse to the clamping jaws 25, 26 and ensures a precise alignment or positioning of the wooden articles 3. The clamping jaw 25 is pivotable about a horizontal axis 32 which is positioned transversely to the longitudinal direction of the clamping jaw. When the wooden articles 3 are to be transferred, in a way to be described in the following, to the advancing unit 15 of the longitudinal profiling unit 2, the clamping jaw 25 can be pivoted about the axis 32 to such an extent in the downward direction into a release position such that the stop 31 is positioned outside of the movement path of the wooden articles 3 (FIG. 8).

FIG. 7 shows the initial position for the transfer of the wooden articles 3 from the clamping device 4 of the transverse profiling unit 1 into the advancing unit 15 of the longitudinal profiling unit 2. The clamping device 4 and the advancing unit 15 have in this initial position a spacing from one another. In the area between the clamping device 4 and the advancing unit 15 an intermediate clamping device 33 is provided which has two clamping jaws 35, 34 arranged atop one another. At least one of them is adjustable in the vertical direction. Moreover, the entire intermediate clamping device 33 is adjustable in the vertical direction. In the area below the intermediate clamping device 33 a transfer unit 36 is provided which comprises two endless circulating belts 37, 38 which are positioned at a spacing above one another. They are supported on a support element 39, 40, respectively, and at least one of the support elements is adjustable in the vertical direction. In this way, the spacing between the two belts 37, 38 can be adjusted simply to the thickness of the wooden articles 3 to be transported. The entire transfer unit 36 is moreover adjustable in the vertical direction.

For transferring the wooden articles 3 from the clamping device 4 to the advancing unit 15, the clamping device 4 is first adjusted in the adjusting direction 30 relative to the intermediate clamping device 33. The two clamping jaws 34, 35 of the clamping device 33 are adjusted such that the wooden articles 3 can be moved reliably between the clamping jaws 34, 35. The clamping device 33 is positioned within an area outside of the adjusting path of the clamping device 4 or its clamping jaws 25, 26. The clamping device 4 is adjusted to such an extent that the wooden articles 3 are completely positioned between the clamping jaws 35, 34 of the clamping device 33 (FIG. 8). As soon as the wooden articles 3 have been moved completely between the clamping jaws 34, 35, one of the clamping jaws, in the embodiment the upper clamping jaw 34, is moved toward the wooden articles 3 which are thus reliably clamped between the clamping jaws 34, 35 of the clamping device 33 (FIG. 8). Subsequently, the lower clamping jaw 25 of the clamping device 4 is pivoted about the axis 32 to such an extend downwardly that the stop 31 of the clamping jaw 25 is located in an area below the wooden articles 3. Now the clamping device 4 can be returned in the direction of arrow 41. This is carried out by a corresponding return of the transverse carriage 5 on which the clamping device 4 is arranged.

Figure 9:
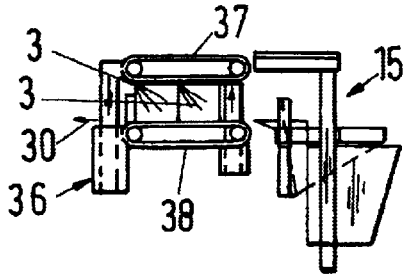
FIG. 9 illustrates the third step of a process sequence for transferring the workpieces to be machined from a first advancing unit to a second advancing unit.

During transfer of the wooden articles 3 from the clamping device 4 to the intermediate clamping device 33, the transfer unit 36 is still in the initial position in the area below the intermediate clamping device 33 (FIG. 8). As soon as the clamping device 4 has been returned, the transfer unit 36 is moved into the transfer position illustrated in FIG. 9. For this purpose, it is necessary that the transfer unit 36 is retracted first in its lowered position in the direction of arrow 42 such that during the subsequent adjustment of the transfer unit 36 in the vertical direction (arrow 43 in FIG. 8) the belts 37, 38 can be moved upwardly to the level of the wooden articles 3 at the side of the intermediate clamping device 33 facing away from the advancing unit 15. In this connection, the two belts 37, 38 have such a spacing from one another that upon subsequent adjustment of the transfer unit 36 in the direction of the intermediate clamping device 33 the wooden articles 3 will be moved between the two belts 37, 38 (FIG. 9). The spacing between the two belts is adjusted such that upon adjustment of the transfer unit 36 into the transfer position the wooden articles 3 are not touched. As soon as the transfer position illustrated in FIG. 9 has been reached, at least one of the support elements 39, 40 of the transfer unit 36 is adjusted such that the wooden articles 3 can be gripped by the belts 37, 38.

Figure 10:
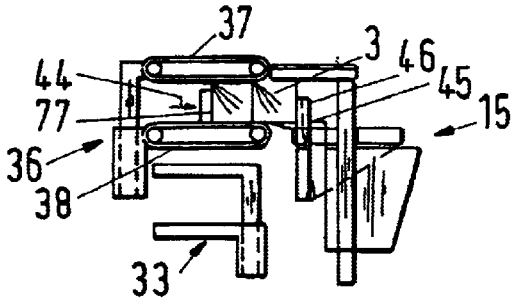
FIG. 10 illustrates the fourth step of a process sequence for transferring the workpieces to be machined from a first advancing unit to a second advancing unit.

As soon as the belts 37, 38 have been adjusted in this way, the clamping jaws 34, 35 of the intermediate clamping device 33 can be opened so that the wooden articles are released. Subsequently, the transfer unit 36 with the clamped wooden articles 3 is retracted in the direction of arrow 30 (FIG. 9) such that the clamping jaws 34, 35 of the intermediate clamping device 33 are in the area outside of the wooden articles 3. Subsequently, the intermediate clamping device 33 is moved downwardly (FIG. 10).

As soon as the intermediate clamping device 33 is in an area outside of the wooden articles 3, the transfer unit 36 is moved counter to the direction of arrow 30 (FIG. 9) near the advancing unit 15. Subsequently, a slide-type transport unit 77 is moved in the conveying direction 44 (FIG. 10) which conveys the wooden articles 3 into the advancing unit 15 of the longitudinal profiling unit 2. The endless circulating belts 37, 38 of the transfer unit 36 rest on the wooden articles 3 and are entrained by the movement of the wooden articles. The belts 37, 38 serve for guiding the wooden articles 3 and prevent an axial movement during this transfer process. The conveying direction 44 (FIG. 10) of the wooden articles 3 is positioned perpendicularly to its longitudinal axis. The advancing unit 15 has clamping jaws uniformly distributed about its length, to be described in the following, with which the wooden articles 3 can be clamped on a support 45. The movement path of the wooden articles 3 in the adjusting direction 44 is limited by the stops 46 which are distributed about the length of the advancing unit 15 against which the wooden articles 3 abut.

Figure 11:
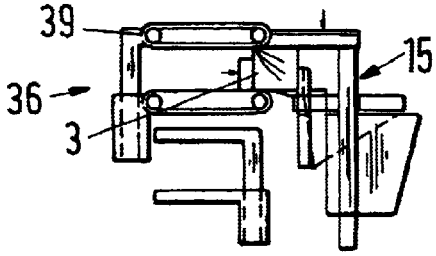
FIG. 11 illustrates the fifth step of a process sequence for transferring the workpieces to be machined from a first advancing unit to a second advancing unit.

Since during longitudinal profiling the wooden articles 3 cannot be positioned adjacent to one another in contrast to transverse profiling, only one wooden article 3 is first transported into the advancing unit 15. As soon as the wooden article 3 contacts the stops 46, the clamping jaws are moved downwardly and this wooden article 3 is clamped in the advancing unit 15. Subsequently, the advancing unit 15 is moved in the advancing direction 21 (FIGS. 2 and 3) to such an extent until the next wooden article 3 is transported in the same way by means of the transport unit 77 into the advancing unit 15 and is clamped therein. FIG. 11 shows the situation in which the advancing unit 15 has been moved forwardly and has transported the second wooden article 3 into the advancing unit 15.

After this second wooden article 3 has been clamped in the advancing unit 15, the upper support element 39 of the transfer unit 36 is moved upwardly so that the transfer unit 36 can be retracted counter to the advancing direction 42 (FIG. 8). Subsequently, the transfer unit 36 is lowered again so that it is available for the next transfer cycle. When the wooden articles 3 to be machined are long, only one wooden article can be clamped in the advancing unit 15 for a corresponding length. Then the carriage 5 must wait in the transfer position until the advancing unit 15 has been returned into the transfer area after transfer of the longitudinally profiled wooden article 3.

Depending on the width of the wooden article, the clamping device 4 of the transverse profiling 1 can receive only one wooden article 3 but also more than two wooden articles. When the wooden article 3 is as wide as the clamping elements of the clamping device 4, the clamping device 4 receives only one wooden article 3 and transfers it in the described way to the advancing unit 15 after machining in the transverse profiling unit 1. When the wooden articles 3 have a comparatively minimal width, the clamping device 4 can clamp three or more wooden articles 3 resting against one another. Depending on the length of these wooden articles 3 and the advancing unit 15, they can be clamped sequentially in the advancing unit 15. When the length of the advancing unit 15 is insufficient to clamp all wooden articles 3 sequentially behind one another in the advancing unit 15, the transfer of the remaining wooden articles 3 is carried out when the advancing unit 15 is returned into its transfer position after machining of the wooden articles received in the longitudinal profiling unit 2. Now the remaining wooden articles 3 can be transferred in the described way to the advancing unit 15.

As long as the wooden articles 3 are still clamped in the intermediate clamping device 33, bores are machined, if needed, into the wooden article 3 advantageously by means of the drilling unit 12 of the transverse profiling unit 1. During this drilling process the clamping device 4 can be returned into the initial position for receiving the next workpiece.

Figure 4:
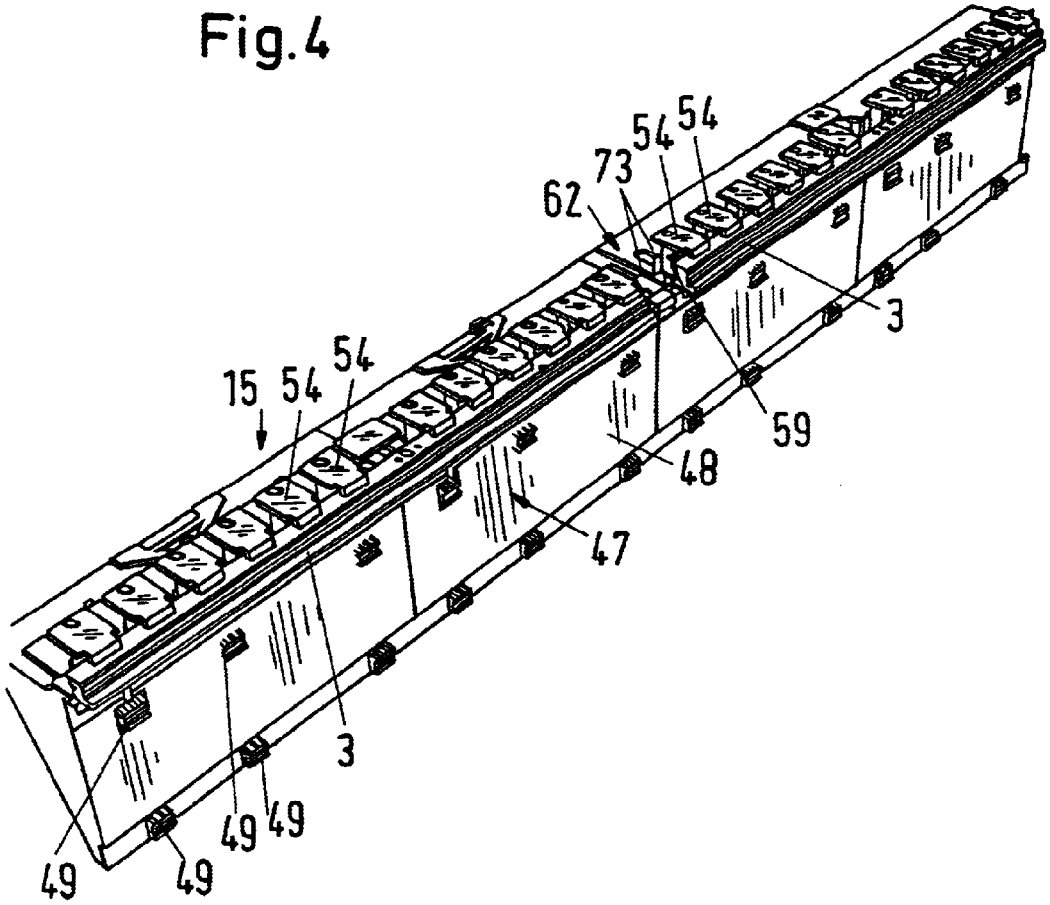
FIG. 4 is a perspective illustration of an advancing unit of the machine according to the invention.
Figure 5:
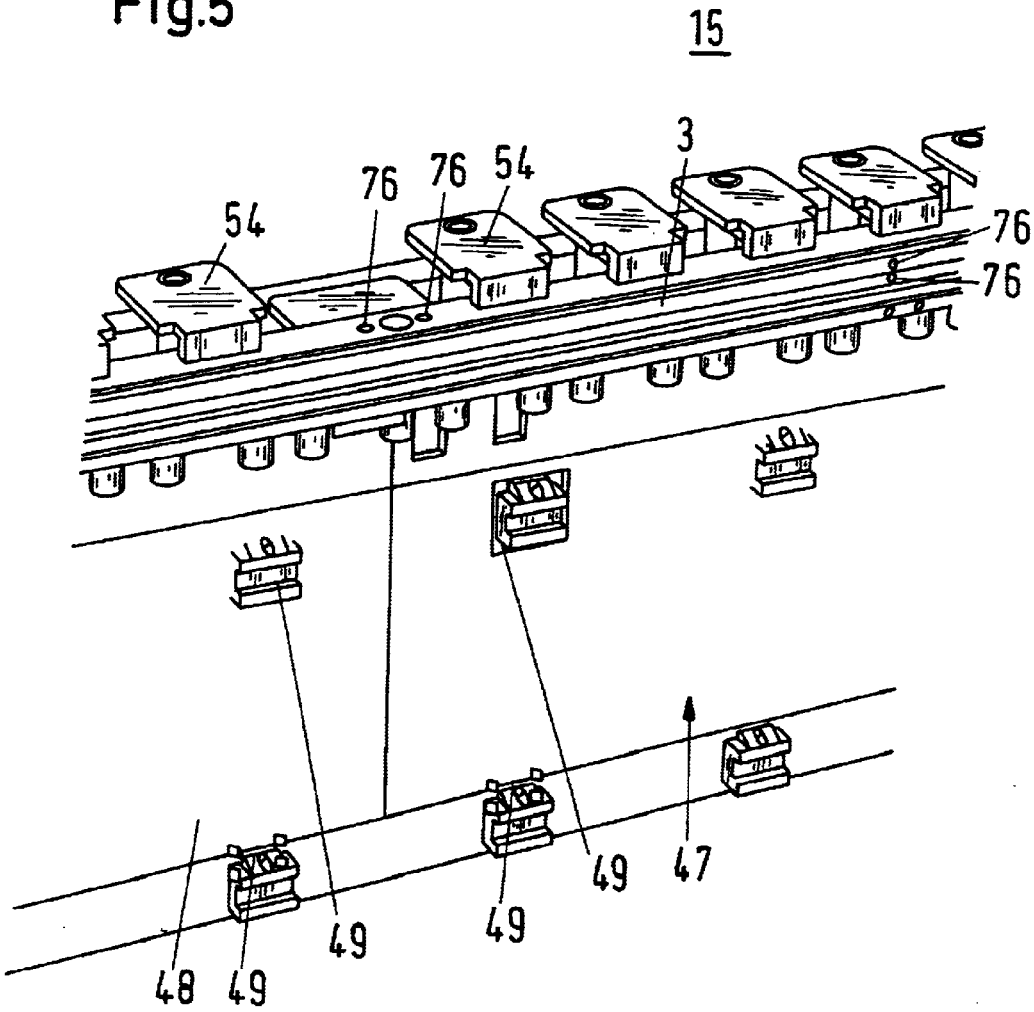
FIG. 5 is a perspective and enlarged illustration of a part of the advancing unit according to FIG. 4.
Figure 14:
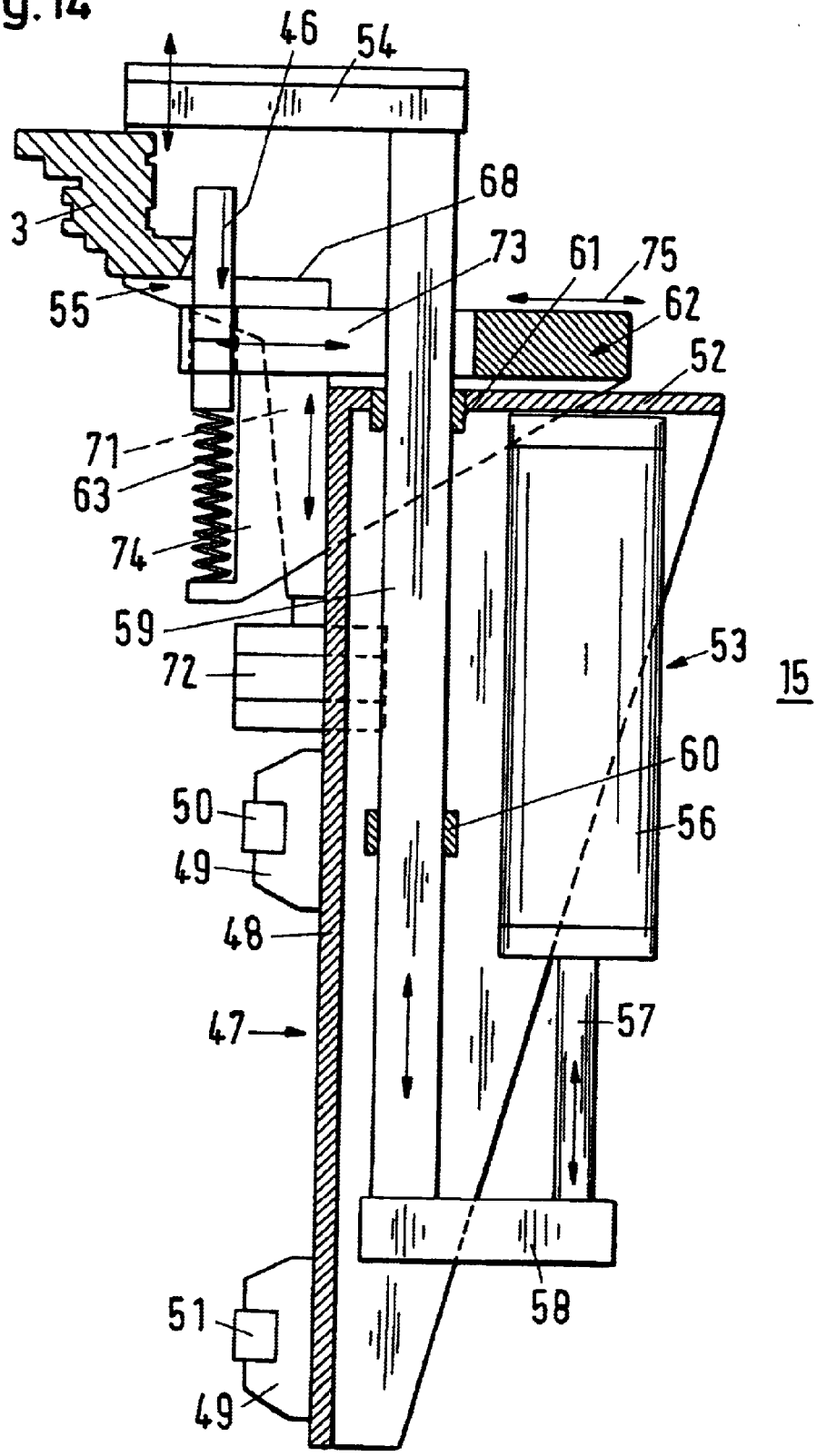
FIG. 14 shows in an enlarged illustration a part of the advancing unit according to FIGS. 4 to 6 in a side view.

With the aid of FIGS. 4 through 6 and FIG. 14, the advancing unit 15 will be explained in more detail. It has a carrier 47 which extends advantageously across the length of the advancing unit 15. The carrier 47 is provided with a vertical back wall 48 on which guide elements 49, distributed across the length, are fastened. These guide elements 49 are arranged in two horizontal rows arranged at a spacing to one another. (FIGS. 4, 5 and 14). By means of the guide elements 49 the advancing unit 15 is positioned on two parallel guide rails 50, 51 (FIG. 14) which are provided on a machine frame (not illustrated).

The upper end of the back wall 48 of the carrier 47 has a transition into a support part 52 positioned perpendicularly to it. At least one drive 53 for the clamping jaws 54 is attached to its underside. The drive 53 has advantageously lifting cylinders 56 (FIG. 14) which are fastened on the underside of the horizontal carrier part 52 and from which a piston rod 57 extends downwardly. It is connected at the lower end by means of a transverse member 58 with an upwardly oriented rod-shaped carrier 59 which projects upwardly through at least one guide 60 as well as a guide bushing 61 past the support part 52 and supports the respective clamping jaw 54 at its upper free end. In this way, all clamping jaws 58 are independently adjustable from one the another in the vertical direction by means of a lifting cylinder 56, respectively. In this way, the individual clamping jaws 54 can be adjusted independently from one another. It is also possible to combine the clamping jaws 54 into groups and to adjust them together in groups.

At least one rake-shaped support 62 is supported on the support part 52 in which the stops 46 for the wooden articles 3 are supported. These stops 46 are advantageously stop bolts which extend perpendicularly past the top side of the support 62 facing the clamping jaws 54, 55 and which are subjected to the force of at least one pressure spring 63 which moves the stops 46 axially into a stop position.

The clamping jaws 54 have in a plan view (FIG. 6) a quadrangular base member 64 which has a rectangular projection 65 on its longitudinal clamping edge. In this way, the clamping jaws 54 are provided on both sides of the projection 65 with rectangular recesses 66, 67. All clamping jaws 54 are of identical configuration and are positioned in a row at a spacing adjacent to one another. The clamping jaws 54 are advantageously screwed onto the upper end of the carrier 59 so that, if needed, they can be simply and quickly exchanged.

The clamping jaws 54 are positioned in the vertical direction opposed to the clamping jaws 55 whose upper sides 68 form the support 45 (FIG. 10) for the wooden articles 3 to be clamped. The clamping jaws 55 are positioned at the same level and are advantageously also adjustable to a limited extent independently from one another in the vertical direction. However, it is also possible to adjust the lower clamping jaws 55 together or in groups in the vertical direction. The adjustment can be realized by means of cylinders. However, it is also possible to adjust the clamping jaws 55 by means of a CNC axis.

Figure 6:
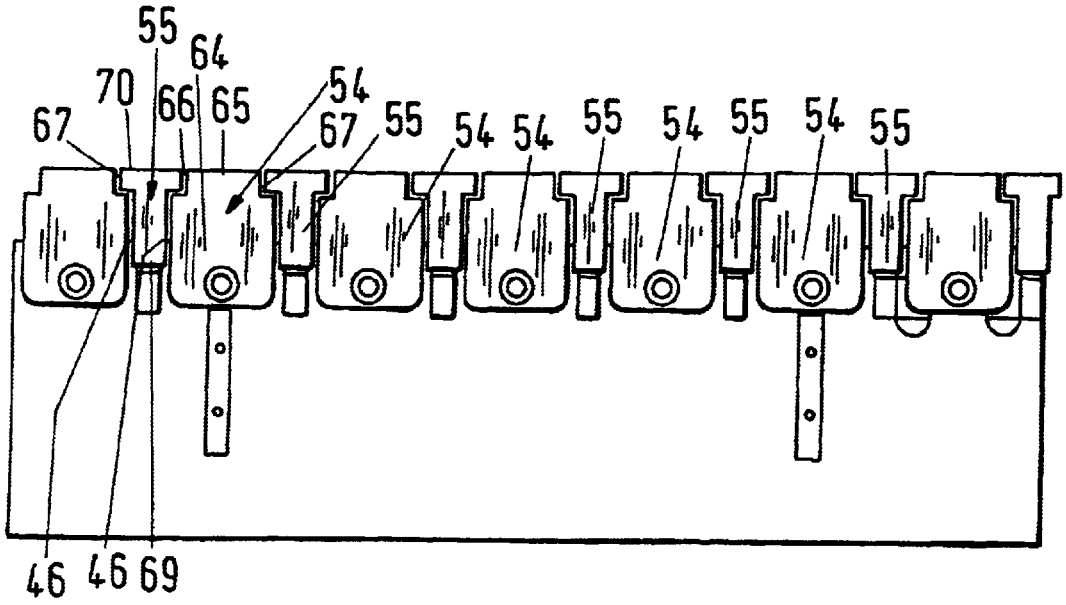
FIG. 6 is a plan view onto a part of the advancing unit according to FIG. 4.

The clamping jaws 55, as illustrated in FIG. 6, are staggered relative to clamping jaws 54, when viewed in a plan view onto the advancing unit 15. The lower clamping jaws 55 have a T-shape with a rectangular leg 69 which is positioned between neighboring clamping jaws 54, viewed in plan view. The lower clamping jaws 55 are moreover provided with a crossbar 70 positioned at a right angle to the leg 69 which, viewed in a plan view, is positioned in the recesses 66, 67 of the neighboring upper clamping jaws 54. Between the individual clamping jaws 54, 55 a small free space is provided, viewed in a plan view. In this way, the upper clamping jaws 54, in a way to be described in the following, can be moved without problem downwardly between the lower clamping jaws 55 and without the risk of touching.

The lower clamping jaws 55 project transversely from a leg 71 (FIG. 14) which connects the clamping jaws 55 with a lifting cylinder 72. By means of the lifting cylinder 72, the lower clamping jaws 55 can be lowered in a way to be described in the following when, as explained in connection with FIGS. 7 through 11, the wooden articles 3 are transferred after transverse profiling to the advancing unit 15. The lifting cylinders 72 are supported on the carrier 47.

The rake-shaped support 62 has horizontally projecting fingers 73 (FIG. 4 and FIG. 14) which are positioned at a spacing to one another between which the rod-shaped carriers 59 for the upper clamping jaws 54 as well as for the legs 71 of the lower clamping jaws 55 project. The support 62 is provided with upright supports 74 positioned at a spacing from one another on which the pressure springs 63 of the stops 31 are supported with one end. The rake-shaped support 62 can be adjusted horizontally in the direction of arrow 75 on the support part 52 of the carrier 47 in order to adjust the position of the stops 46 to the cross-sectional shape of the wooden articles 3 to be clamped. The drive provided for this is not illustrated. The adjustment of the rake-shaped support 62 can be manually performed. Advantageously, it is adjusted in a controlled fashion so that an automated adjustment of the stops 46 relative to the cross-sectional shape of the wooden articles 3 to be machined is ensured.

The advancing unit 15 can also have two or more adjacently positioned supports 62 which are advantageously adjustable independently from one another in the way described above in order to clamp several wooden articles behind one another which are to be machined with different widths.

As has been explained in connection with FIGS. 7 to 11, the wooden articles 3 are not directly transferred from the transverse profiling unit 1 to the advancing unit 15 of the longitudinal profiling unit 2, but instead by means of the transfer unit 36. It is arranged in the transfer position (FIG. 9) such relative to the advancing unit 15 that the belts 37, 38 of the transfer unit 36 have only minimal spacing from the clamping jaws 54, 55 of the advancing unit 15. In this way, the wooden articles 3 can be transported without problems from the transfer unit 36 into the advancing unit 15. In order to achieve a disturbance-free and optimal transfer of the wooden articles 3, the lower clamping jaws 55 are lowered minimally before transfer of the wooden articles to such an extent that the support side 68 of the lower clamping jaws 55 is positioned below the support plane of the lower belt 38 of the transfer unit 36. In this way, the wooden article 3 can be transported without problems between the two clamping jaws 54, 55 of the advancing unit 15.

The stops 46 are adjusted in the required position by a corresponding movement of the rake-shaped support 62 in the movement direction 75 before transfer of the wooden articles 3. The upper clamping jaws 54 have been adjusted slightly upwardly during the transfer so that they will not impede the transfer process. As soon as the wooden articles 3 rest against the stops 46 distributed across the length of the advancing unit, the upper and the lower clamping jaws 54, 55 are moved toward one another by actuating the corresponding lifting cylinders 56, 72. In this way, the wooden articles 3 are clamped optimally between the clamping jaws 54, 55 of the advancing unit 15. The clamping action is such that the longitudinal side of the wooden articles 3 to be machined by the longitudinal profiling tools 18 is exposed so that this longitudinal side can be machined without being impeded by the clamping jaws 54, 55. During the longitudinal profiling action, the advancing unit 15 is reliably moved along the guide rails 50, 51. Since the guide elements 49 are distributed across the length of the carrier 47 and, moreover, are fastened in two horizontal rows positioned above one another at a sufficient spacing relative to one another, the carrier 47 can be moved problem-free and without the risk of canting. In this way, a very precise machining of the wooden articles 3 is ensured.

The advancing unit 15 not only provides the transport device for the wooden articles in the longitudinal profiling unit 2 but simultaneously also the clamping device. In this way, a highly precise machining of the wooden articles is optimally ensured also during the longitudinal profiling process.

As shown in FIG. 14, the longitudinal side of the wooden articles 3 projects sufficiently past the clamping jaws 54, 55 of the advancing unit. In this way, on this longitudinal side the required machining can be carried out. FIG. 5 shows that on this longitudinal side of the wooden article 3, for example, two bores 76 are provided in the longitudinal side and two bores 76 in the top side of the wooden article 3 by means of the drilling units 16. The drive of the advancing unit 15 is embodied as a CNC axis so that the clamped wooden article 3 can be moved into the exact position for drilling. In the area in which the two bores 76 are machined into the top side of the wooden article 3, the corresponding upper clamping jaw 54 of the advancing unit 15 has been lowered. In this way, the wooden article 3 is exposed at this location so that with the corresponding drilling unit 16 the bores can be produced. Since the drive of the advancing unit 15 is embodied as a CNC axis, the corresponding clamping jaws 54 which could impede the further machining of the wooden article 3 in the longitudinal profiling unit 2 can be lowered before transport of the wooden articles 3 into the advancing unit below the support plane 68 of the lower clamping jaws 55 by actuating the corresponding lifting cylinders 56. The wooden article 3 clamped in the advancing unit 15 can then be moved precisely relative to the drilling units 16 of the machine which provide the required bores at the precise position.

Figure 12:
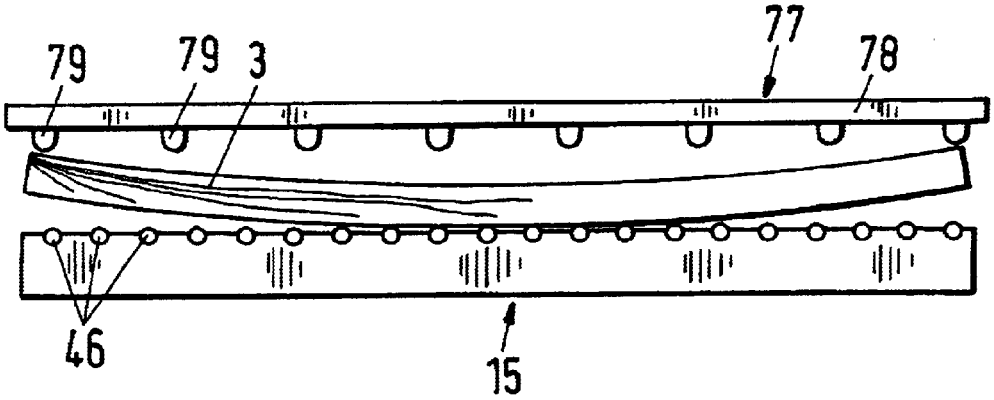
FIG. 12 shows a transport unit of the machine according to the invention in an initial position.
Figure 13:
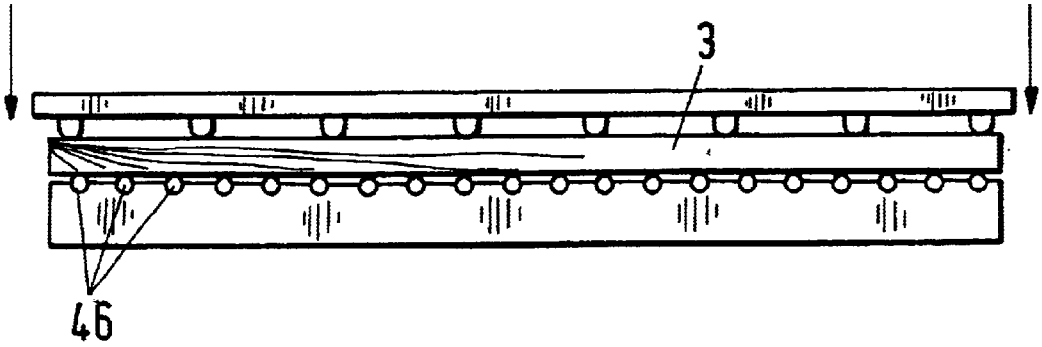
FIG. 13 shows the transport unit according to FIG. 12 in a working position.

By means of FIGS. 12 and 13 the transport unit 77 will be described with which the wooden articles 3 are moved in the described way from the transfer unit 36 into the advancing unit 15.

The transport unit 77 has a plate-shaped carrier 78 which has spaced-apart pressing jaws 79 at the side facing the wooden article 3. The pressing jaws 79 extend across the height of the carrier 78 and the wooden article 3. The end faces of the pressing jaws 79 are rounded so that they only with a line contour on the wooden article 3. The transport unit 77 is adjusted by means of a drive (not illustrated), preferably by lifting cylinders, in the direction toward the stops 46 of the advancing unit 15.

The transport unit 77 is located in the transition area of the wooden articles 3 from the transverse to the longitudinal profiling unit and is a component of the transfer unit 36. The transport unit 77 is actuated when the wooden articles 3 are moved between the opened clamping jaws 54, 55 of the advancing unit 15. The clamping jaws 54, 55 remain open until the wooden article 3 has been brought into contact with the stops 46 by means of the transport unit 77. Now the clamping jaws 54, 55 of the advancing unit 15 are actuated so that they clamp the wooden article 3. Only after this clamping process has been completed, the transport unit 77 is returned into its initial position.

Wooden articles 3 which have over their length a slight curvature can also be pressed straight by means of the transport unit 77 in order to be able to properly machine such wooden articles despite their longitudinal curvature. When the curved wooden article 3 is brought into contact in the described way with the transport unit 67 against the stops 46 of the advancing unit 15, the transport unit 77 is moved by means of further pressure loading farther in the direction to the stops 46. In this way, the wooden article 3 is straightened while resting against the stops 46 (FIG. 13) so that is rests with one longitudinal side against the stops 46. The transport unit 77 remains in its pressing position according to FIG. 13 until the clamping jaws 54, 55 of the advancing unit 15 have clamped the straightened wooden articles 3. The clamping force of the clamping jaws 54, 55 is so high that the wooden article 3 remains in its straightened position in the advancing unit 15 after return of the transport unit 77.

Figure 15:
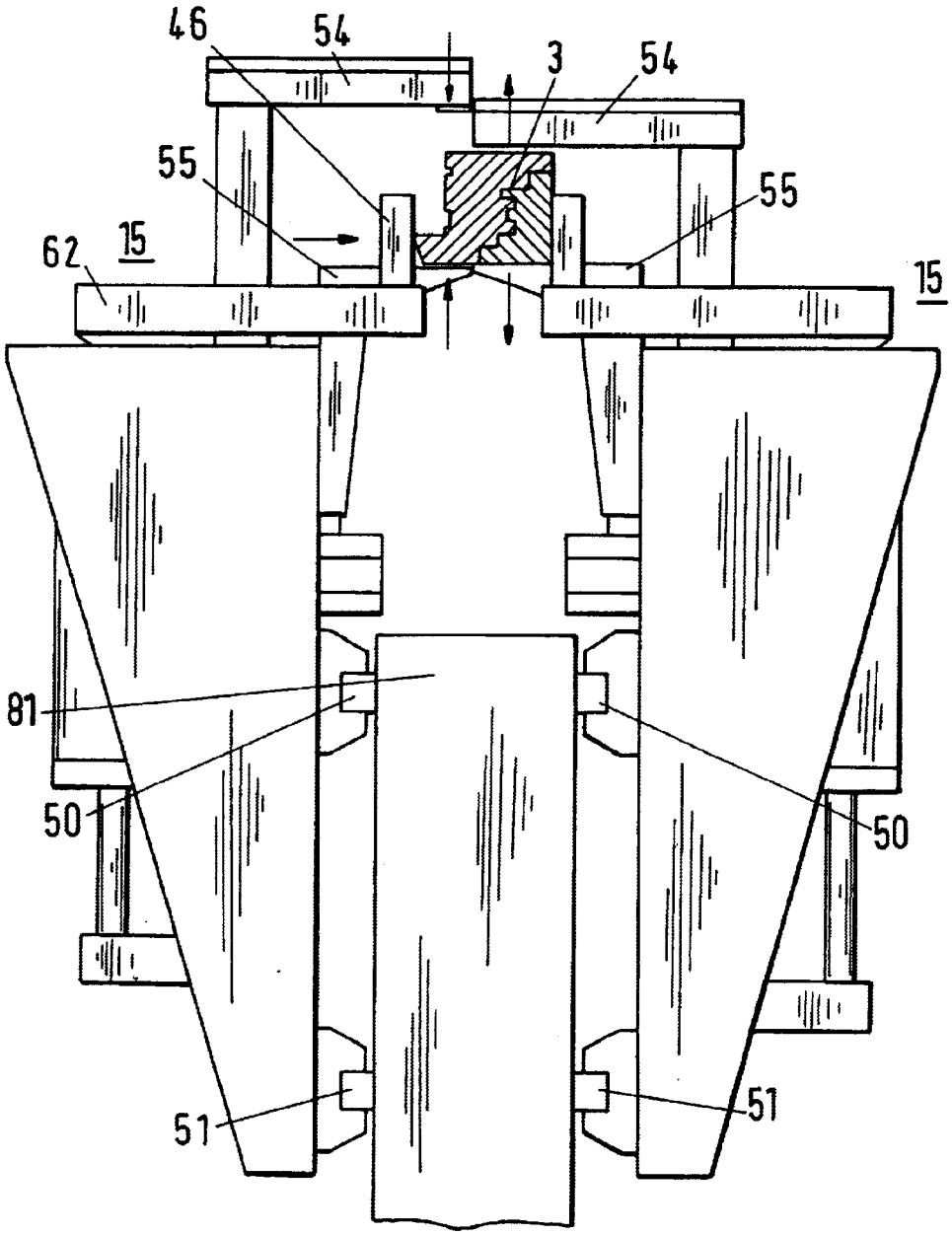
FIG. 15 shows in an enlarged illustration two advancing units of the machine according to FIG. 2, viewed from the exit side of the machine.

FIGS. 2 and 15 show a machine with two longitudinal profiling units which is thus provided with two advancing units 15. As shown in FIG. 15, these two advancing units 15 are identical but arranged mirror-symmetrically relative to one another. When the wooden articles 3 in the described way are clamped in the advancing unit 15 to the right in FIG. 2, the wooden articles are advanced by it past the drilling units 16 and past the longitudinal profiling tools 18 with which the longitudinal side of the wooden articles 3 to the right in the transport direction is machined. The left advancing unit 15 of FIG. 2 is positioned in a transfer area 80 (FIG. 2) which is provided in an area between the two drilling units 16 and the longitudinal profiling tools 18. The two advancing units 15 are arranged to one another such that, viewed in the transport direction 21 (FIG. 15), their clamping shows 54, 55 have only minimal spacing to one another. The wooden articles 3 are clamped such in an advancing unit 15 that they project in the described way sufficiently past the clamping jaws 54, 55. This projecting length is so large that the clamping jaws 54, 55 of the other advancing unit 15 can clamp the wooden article in its area.

FIG. 15 shows the machine in a view onto the exit side. The right advancing unit 15 has moved the wooden article 3 along the corresponding tools in the longitudinal profiling unit 2 such that in FIG. 15 the left longitudinal side of the wooden article 3 has been profiled, wherein this longitudinal side in the direction of movement of the wooden article through the machine is the right longitudinal side. When this advancing unit 15 moves into the transfer area 80, the clamping jaws 54, 55 of the advancing unit 15 to the left in FIG. 15 are opened to such an extent that the wooden article 3 with its projecting area move freely between the clamping jaws of this advancing unit 15. The rake-shaped support 62 with the stops 46 is moved in the direction toward the wooden article 3 such that the stops 46 will come to rest against it. Subsequently, the clamping jaws 54, 55 of this advancing unit 15 are closed and the projecting area of the wooden article 3 is accordingly clamped. Subsequently, the clamping jaws 54, 55 of the right advancing unit 15 in FIG. 15 can be opened so that this wooden article 3 is clamped only by the clamping jaws 54, 55 of the left advancing unit 15. The right advancing unit 15 of FIG. 15 can then be returned in order to receive the next wooden articles 3 from the transverse profiling unit 1 in the described way. The left advancing unit 15 in FIG. 15 now guides the wooden article 3 along the corresponding tools such that the longitudinal side to the right in FIG. 15 of the wooden article 3 is profiled which is the left longitudinal side in the direction of movement of the wooden article 3.

The two advancing units 15 are moved in the described way on opposed sides on a frame part 81 by means of the guide rails 50, 51.

In another embodiment, not illustrated, the machine is provided with advancing units 15 which are arranged in pairs atop one another; the upper advancing units are arranged mirror-symmetrically relative to a horizontal axis above the lower advancing units 15. With such a configuration the output of the machine is increased because one advancing unit has been returned already into the respective transfer position while the second advancing unit guides the wooden article 3 past the respective longitudinal profiling unit.

The longitudinal advancing action of the wooden articles 3 in the longitudinal profiling unit 2 by means of the advancing unit 15 enables an exact monitoring, measuring, and positioning of the wooden articles by means of axes. In this way, a high manufacturing precision and high process reliability are insured. The milling and drilling actions are performed in one machine so that a complete machining of the parts is possible on the machine. The wooden articles 3 during their transport through the transverse and the longitudinal profiling units 1, 2 are always clamped and cannot slide on the table surfaces or stops, the corresponding side of the wooden articles is treated gently. Also, no rolling of cuttings into the surface occurs. By means of the advancing unit 15 and the clamping device 4, it is possible to move the wooden articles 3 several times past the corresponding tools 11, 18 in order to carry out machining actions on the wooden article 3. In this connection, the corresponding spindles 10, 17 are adjusted radially and/or axially in order to engage the wooden article with the cutting knives required for different machining.

Since the wooden articles 3 during the entire machining and also during the different transfer procedures are clamped fixedly, the position of the wooden articles 3 can be precisely determined at any point in time. In this way, it is possible to machine the wooden articles 3 with this machine with high manufacturing precision. In particular, this enables in the described way that the bores and/or milling cuts can be machined in the longitudinal profiling unit 2 with the drilling units 16 of the machine because the wooden articles 3 can be positioned precisely relative to the drilling units 16 by means of the advancing unit 15.

Since the drive of the advancing unit 15 is embodied as a CNC axis, it is also possible to perform immersion cuts on the wooden articles 3. This refers to profilings which do not extend over the entire length of the wooden article 3. As a result of the high positional precision, the corresponding tools can be exactly immersed into and removed from the wooden article.

Since the advancing unit 15 is moved by CNC control and the tools 18 and their spindles 17 are moveable by CNC-control transversely to the movement direction of the advancing unit 15, by interpolation of these two perpendicularly positioned movement directions of the spindle 17 and the advancing unit 15 any contour of the longitudinal side of the wooden articles can be obtained. For example, it is possible to produce on the wooden articles curved profiles, wave lines and the like without problems.

With the clamping device 4 and the advancing unit 15 it is also possible to reliably machine very short wooden articles 3. In this way, complex customized manufacture is eliminated.

The machine parts are embodied as modules so that the machines can be combined in different ways. The configuration of the machine is independent from its length because a corresponding number of modules can be combined for a corresponding machining length. The modules can be combined such to a machine that it can be used as a right-handed or left-handed unit.

The magazine 24 (FIG. 1) can be embodied such that the wooden articles 3 to be machined are automatically removed from it and introduced into the machine and returned into the magazine after machining. The machine can thus operate without an operator because a high process safety is ensured.

Since the wooden articles 3 are not transported through the machine while resting against a stop but are instead clamped by means of the clamping device 4 or the advancing unit 15, a variable material removal on the wooden article 3 can be controlled without problems via the spindle position. This results in a high flexibility and an optimal lumber use.

The spindle guides are comprised advantageously of concrete polymer so that an optimal vibration decoupling of the spindles can be achieved.

The spindles can have, for example, a length of 700 mm and a variable stroke of 650 mm. In this way, complete freedom with regard to the spindle use, i.e., the selection of the tools to be fastened on the spindle, is provided. This provides a simple project planning of the wood machining process.

Since all wooden article and tool movements are realized by control of the electric axes, a high precision, a great variability as well as a significant simplification of project planning are obtained. Since via the controlled axes a precise knowledge of the position of the wooden article 3 within the machine is ensured, it is possible to eliminate light barriers which are employed in conventional window making machines and often represent significant sources of errors in the prior art window making machines. When the machine is configured as a continuous device according to FIG. 2, mechanized devices of the machine can be eliminated, such as return devices, pivot devices and the like. For positioning the wooden articles 3, a longitudinal stop is not required so that very small longitudinal tolerances of the wooden articles 3 to be machined result. Since the wooden articles are controlled by electronic axes at least in the machining phases, limit switches in the advancing device of the machine for following the movement of the wooden articles can be eliminated. As a result of the controlled cycle sequence of the machine, a buffer or magazine and its control are not required.

Since the wooden articles 3 are transported by the clamping device 4 or the advancing unit 15 during transverse and longitudinal profiling, the tabletops for supporting and propping up the wooden articles are no longer required. The problems which occur in this connection with regard to wear and guide interruptions in the area of the spindles are thus eliminated. Also, the stops to the right required in conventional window making machines, which cause problems with regard to wear, milling work and adjusting work, guide interruption in the area of the spindles as well as an optimal cuttings collection, can be eliminated.

The advancing units in the form of advancing rollers employed in conventional window making machines and the problems correlated therewith are eliminated. Advancing rollers are subject to wear and soiling so that the transport of the wooden articles through the window making machine is impeded. Moreover, the advancing rollers must be adjusted. As a result of the advancing beams the tools are difficult to access on the window making machine. The position of the wooden articles in the machine must be monitored for such an advancing unit by limit switches, and this can cause problems.

When the wooden articles are assembled to a window or door frame or wing, this frame or wing is subsequently transported through the window making machine and a circumferential milling action is performed. This circumferential milling action is impeded by the advancing beam. The milling action on smaller frames or wings requires an additional circumferential milling carriage. Such circumferential milling carriages are particularly unsuitable for studio windows in which the frame parts are connected to one another at angles different from 90°.

Figure 16:
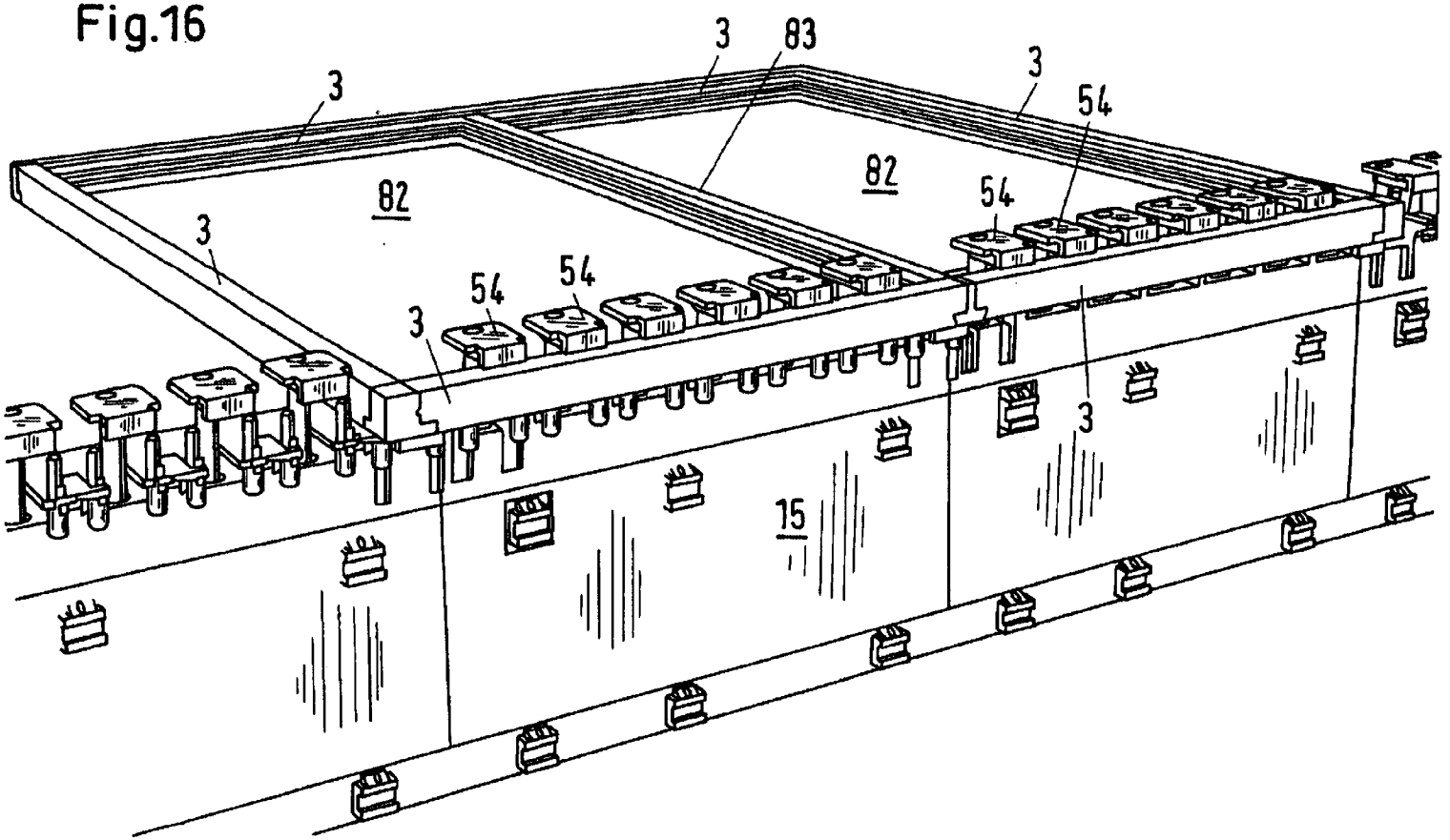
FIG. 16 shows in a perspective illustration a part of the machine according to the invention for machining a rebate.
Figure 17:
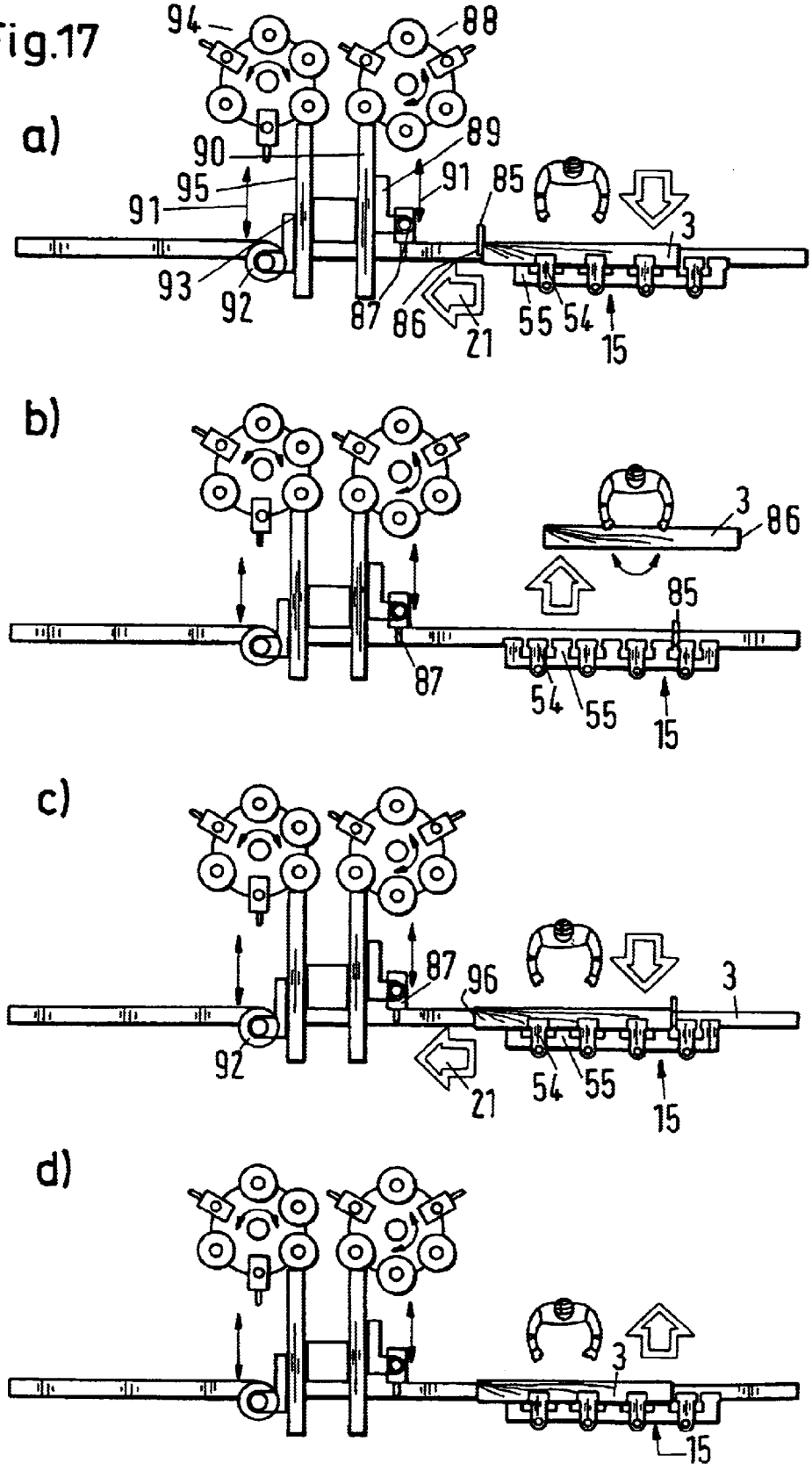
FIG. 17*a* to FIG. 17*d* illustrate sequential method steps when performing the method according to the invention on another embodiment of the machine according to the invention.

Such problems do not occur in the described machine because the advancing unit 15 can be used even for the circumferential milling action. As shown in FIG. 16, the frame 82 comprised of the wooden articles 3 machined in the machine is machined on the exterior side of the frame parts, in particular, by milling. The frame 82 is placed with one frame part 3 against the stops 46 of the advancing unit 15 and clamped in the described way with the clamping jaws 54, 55. Since the other frame parts project perpendicularly from the clamped frame part 3, the clamping jaws 54 which are positioned in the area of these transversely projecting frame parts are lowered below the support plane 68 of the lower clamping jaws 55 before clamping the frame 82 (FIG. 14). Lowering of the corresponding clamping jaws 54 is carried out program-controlled as a function of the frame 82 to be milled. Accordingly, the frame 82 can be introduced without problems into the advancing unit 15 and clamped therein. The lower clamping jaws 54 entrain the stops 46 positioned in their movement path against the force of the pressure springs 63. As illustrated in FIG. 6, the clamping jaws 54 have such a width in the area of the base members 64 that they can engage simultaneously two stops 46 and push them downwardly.

FIG. 16 shows a wing frame 82 with a crossbar 83. By means of the advancing unit 15, it is also possible to clamp two or more frames 82 positioned adjacent to one another in order to mill the exterior sides. The number of frames 82 to be simultaneously clamped depends on the length of the advancing unit 15 and the length or the width of the frame.

By means of the advancing unit 15 the wooden article 3 is secured during its transport through the machine, in particular, also in the area of the respective tools. In this way, a left pressing action, as provided with conventional window machines, can be eliminated. The fixed clamping action in all advancing and clamping devices does not cause depressions, grooves or the like in the wooden article 3.

By means of the drawings, the machine has been illustrated as an angled machine which has transverse and longitudinal profiling units 1, 2 positioned at a right angle to one another. The described advancing unit 15 can also be provided in a machine which does not have a transverse profiling unit and with which the wooden articles 3 are thus machined on at least one longitudinal side only.

The machine according to FIGS. 17*a* to 17*d* is used primarily for machining furniture parts and has no transverse profiling unit. The wooden articles 3 are either placed manually or by means of a magazine onto the advancing unit 15 and are clamped with the upper and lower clamping jaws 54, 55. One end face of the wooden articles 3 is brought into contact with a stop 85 of the machine in order to obtain a longitudinal reference measure. In order for the wooden articles to be machinable at their end face 86 resting against the stop 85 in a way to be described in the following, the wooden articles project past the clamping jaws 54, 55 in the transport direction. As soon as the wooden articles 3 are aligned on the longitudinal stop 85 and clamped with the clamping jaws 54, 55, the stop 85 is removed from its stop position and the advancing unit 15 is transported in the transport direction 21.

During the transport in the transport direction 21 the wooden articles 3 first reach the working area of the tool 87 with which a corresponding machining on the end face 86 of the wooden articles 3 is performed. The tool 87 can be a removed from a tool magazine 88 in which milling cutters, drills, angle machining units, saws etc. are arranged. The tool 87 is positioned on a carriage 89 movable transversely to the transport direction 21 which can be moved along a guide 90 perpendicularly to the transport direction 21 in the transport direction 91 between the tool magazine 88 and the machining location. After machining of the end face 86, the wooden article 3 is transported by means of the advancing unit 15 in the transport direction 21 to a downstream tool 92. It is seated also on a carriage 93 which can be moved along a guide 95 perpendicularly to the transport direction 21 between an additional tool magazine 94 and its machining location. The tool magazine 94 can be identical to the tool magazine 88 and can have different tools for longitudinal machining, transverse machining, for boring or for sawing of the wooden articles 3. With the advancing unit 15 the wooden articles 3 are guided past the rotating tool 92 which machines the longitudinal side of the wooden article 3 to the right in the transport direction 21.

Once the longitudinal machining of the wooden article 3 is complete, the advancing unit 15 is returned counter to the transport direction 21 to the operator. After releasing the clamping device, the operator removes the wooden article 3 and turns it about its transverse axis by 180° (FIG. 17*b*). This turned wooden article 3 is clamped again between the clamping jaws 54, 55 of the advancing unit 15. The wooden article 3 is then placed after turning with its machined end face 86 against the stop 85 of the machine which in this case can be moved from the position illustrated in FIG. 17*a* into the position according to FIG. 17*b*. However, it is also possible to provide a second stop on the machine in order to align the partially machined wooden article 3. After clamping, the advancing unit 15 is moved again in the transport direction 21. The other end face 96 of the wooden article 3 (FIG. 17*c*) is machined with the tool 87. In order to enable a problem-free machining of this end face, the wooden article 3 is clamped such between the clamping jaws 54, 55 that the wooden article 3 projects sufficiently far in the transport direction 21 past the advancing unit 15. After machining the end face 96, the tool 87 is returned transversely to the transport direction 21. The advancing unit 15 is then moved farther in the transport direction 21 and the wooden article 3 is past along the tool 92 with which the other longitudinal side of the wooden article 3 is now machined. As soon as the longitudinal machining of the wooden article 3 has been completed, the advancing unit 15 is returned into its initial position (FIG. 17*d*). The operator can remove the article 3, which has been machined on both oppositely positioned longitudinal sides and on its end faces 86, 96, from the advancing unit 15 (FIG. 17*d*).

With the described method the wooden article 3 is moved twice through the machine by means of the advancing unit 15 wherein for each pass through the machine an end face and a longitudinal side of the wooden article 3 is machined.

Figure 18:
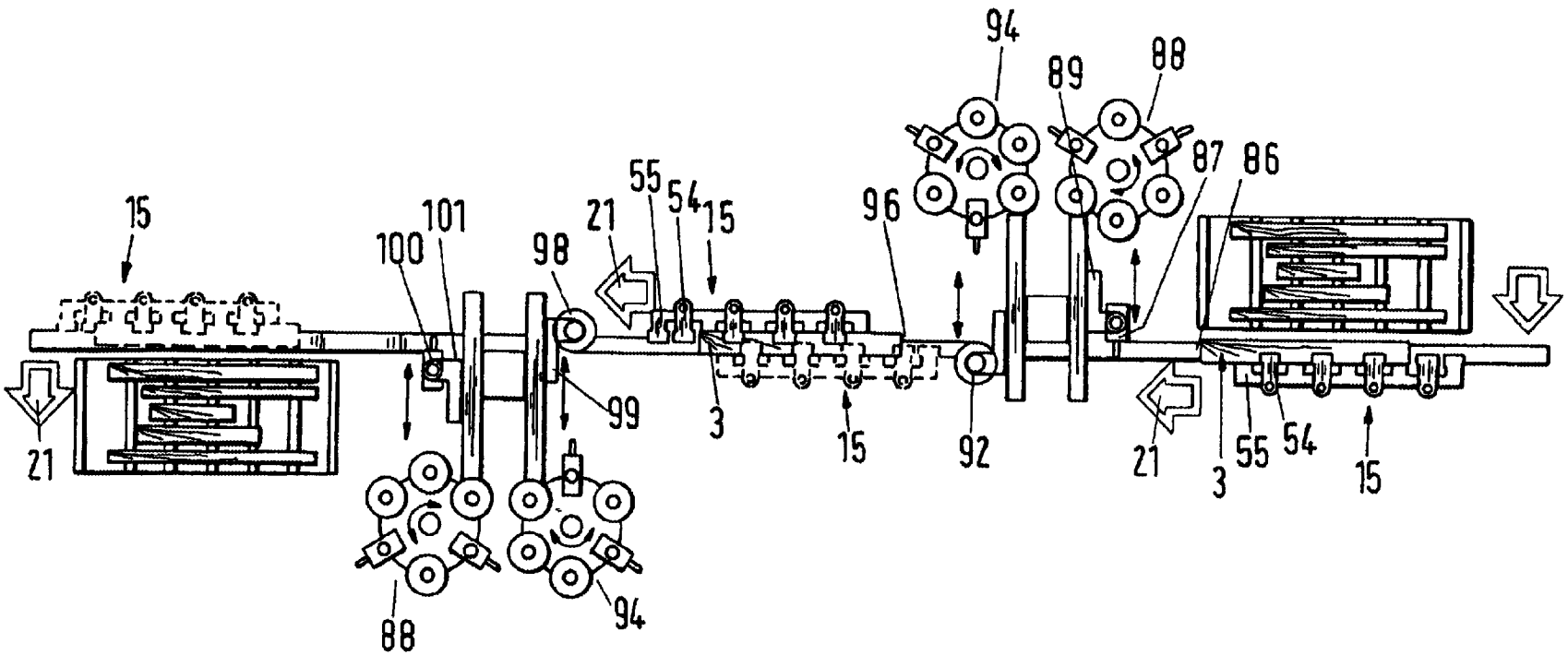
FIG. 18 is a plan view of another embodiment of the machine according to the invention.
Figure 19:
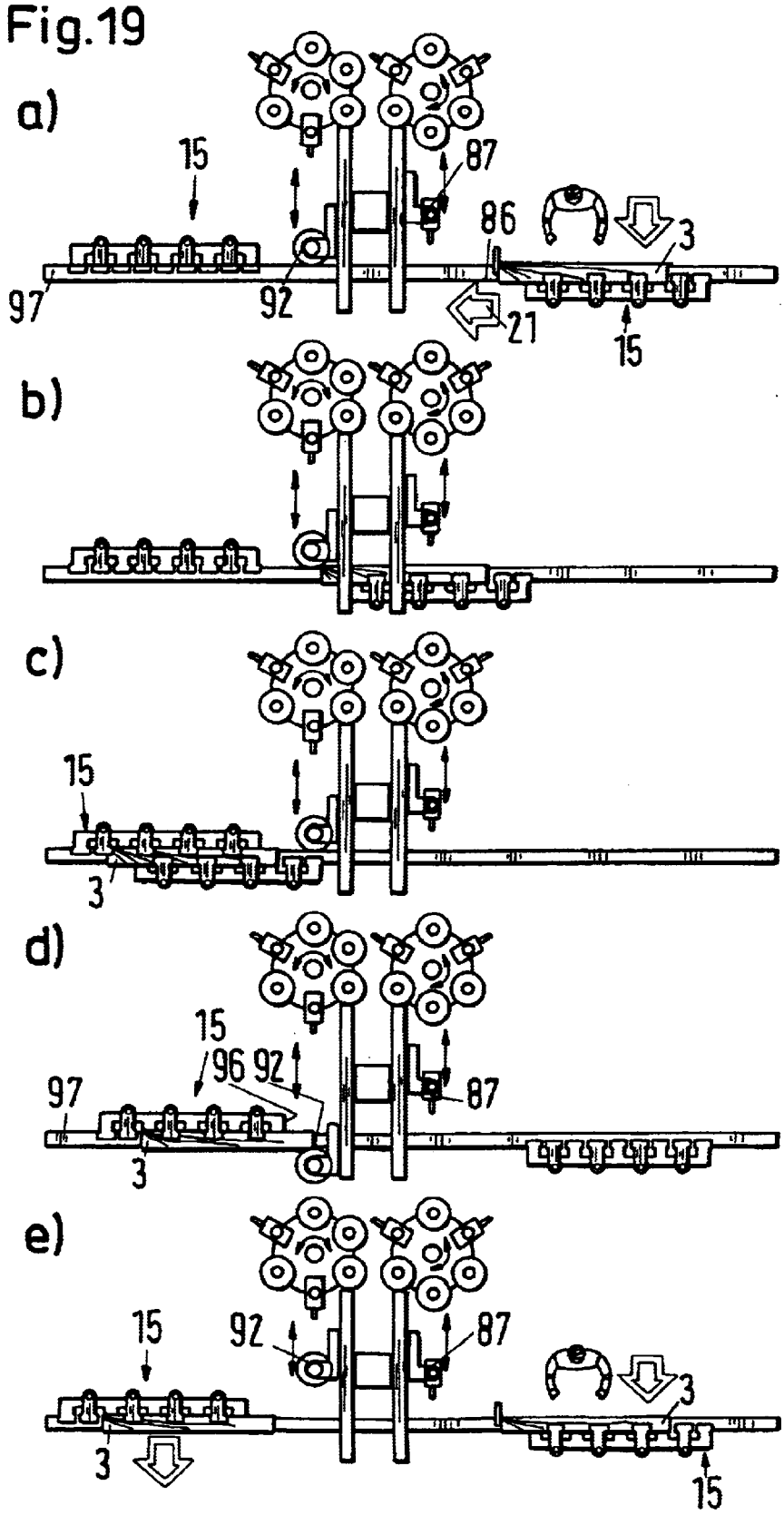
FIG. 19*a* to FIG. 19*e* illustrate sequential method steps for machining workpieces on another embodiment of the machine according to the invention.

FIG. 18 shows an embodiment in which the wooden article 3 is machined in a single pass through the machine on both longitudinal sides and both end faces. The wooden article to be machined is placed onto the clamping unit of the advancing unit 15 either manually by an operator or automatically by a magazine. The wooden article is clamped between the clamping jaws 54, 55 of the advancing unit 15. The leading end of the wooden article 3 in the transport direction 21 projects sufficiently past the advancing unit 15 so that by means of the tool 87 the end face 86 of the wooden article 3 can be machined. After this end face machining the tool 87 is returned by means of the carriage 89 and the advancing unit 15 is moved farther in the transport direction 21. The wooden article 3 then reaches the area of the tools 92 with which the longitudinal side of the wooden article 3 to the right in the transport direction 21 is machined. In accordance with the preceding embodiment, the wooden article 3 projects sufficiently far past the clamping jaws 54, 55 so that this longitudinal side can be machined properly.

In the transport direction 21 behind the tool 92, the wooden article 3 is transferred to a second advancing unit 15 which is arranged mirror symmetrically on the opposite side of the guide 97 for the two advancing units 51. The wooden article 3 is transferred to the further advancing unit 15 such that the wooden article 3 projects past this advancing unit 15 with its end pointing in a direction opposite to the transport direction 21. The additional advancing unit 15 also has clamping jaws 54, 55 with which the wooden article is clamped at the top and bottom side. Upon transfer, the wooden article 3 is clamped with the clamping jaws 54, 55 of the additional advancing unit 15 while the clamping jaws 54, 55 of the other advancing unit 15 still hold the wooden article 3 in the clamped position. In this way, a proper transfer of the wooden article 3 is ensured because it is always in a clamped position during this transfer.

After the transfer the additional advancing unit 15 is moved farther in the transport direction 21. By means of the tool 98, which is adjustable by a carriage 99 transversely to the transport direction 21, the longitudinal side of the wooden article 3 to the left in the transport direction 21 is machined. With the tool 100 downstream in the transport direction 21, which is also supported on a carriage 101, the trailing end face 96 of the wooden article 3 in the transport direction is machined subsequently.

After passing through the machine, the wooden article 3 has been machined on both end faces 86, 96 and the right and left longitudinal sides. The wooden article 3 is then removed from the advancing unit 15 and guided farther perpendicularly to the transport direction 21 after releasing the clamping device.

With this machine the wooden articles 3 are machined on its two opposed longitudinal sides by means of two advancing units 15 which are advantageously identical and arranged mirror-symmetrically to one another. This machine operates very productively. As has been described in connection with the embodiments of FIGS. 1 through 16, it is also possible to produce bores in the top and bottom side of the wooden articles 3 with the additional embodiments.

As in the preceding embodiment, the machine has a magazine 88, 94 for the tools 86, 92, respectively. In this way, there is always one unit in use so that the machine has a high productivity and short throughput time. It is also possible to provide only one unit for longitudinal and transverse machining. In this case, however, an unproductive time period must be taken into account for the exchange of the tools for transverse and longitudinal machining.

Corresponding to the preceding embodiment, the machine according to FIGS. 19*a* to 19*e* has two advancing units 15 which are arranged mirror-symmetrically to one another on opposite sides of the guide 97. Both advancing units 15 are advantageously identical. The operator clamps the wooden article 3 to be machined in the advancing unit 15 in the way explained with the aid of FIG. 17. The advancing unit 15 is subsequently guided in the transport direction 21 along the tools 87, 92 with which in the described way the leading end face 86 in the transport direction and the longitudinal side of the wooden articles 3 to the right in the transport direction are machined.

In the transport direction downstream of the tool 92 the second advancing unit 15 is positioned to which the wooden article 3 is transferred (FIG. 19*c*) in the way explained in detail in connection with FIG. 18. With this second advancing unit 15 the wooden article 3 is returned counter to the transport direction 21 along the guide 97. When doing so, the other end face 96 and the longitudinal side, to the right in the transport direction of this second advancing unit 15, of the wooden article 3 are machined by means of the tools 92, 87. After passing through the machine twice the wooden article has thus been machined on both longitudinal sides and both end faces 86, 96. After the second pass in the transport direction 21, the wooden article 3 is returned by the second advancing unit 15 (FIG. 19*e*), wherein the two tools 87, 92 have been returned. Now the finish-machined wooden article is removed from the second advancing unit 15. While this is carried out, the operator can clamped the next wooden article 3 to be machined in the first advancing unit 15.

Figure 20:
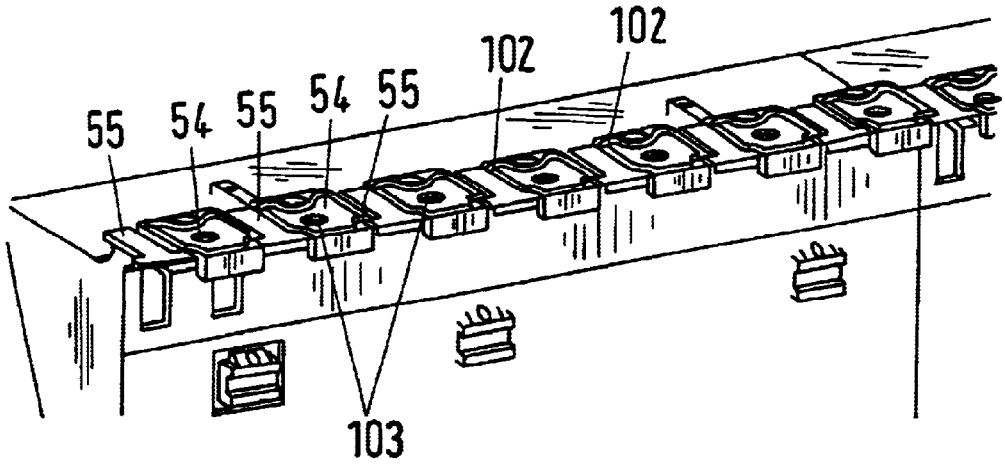
FIG. 20 is a perspective view of another embodiment of an advancing unit of the machine according to the invention.
Figure 21:
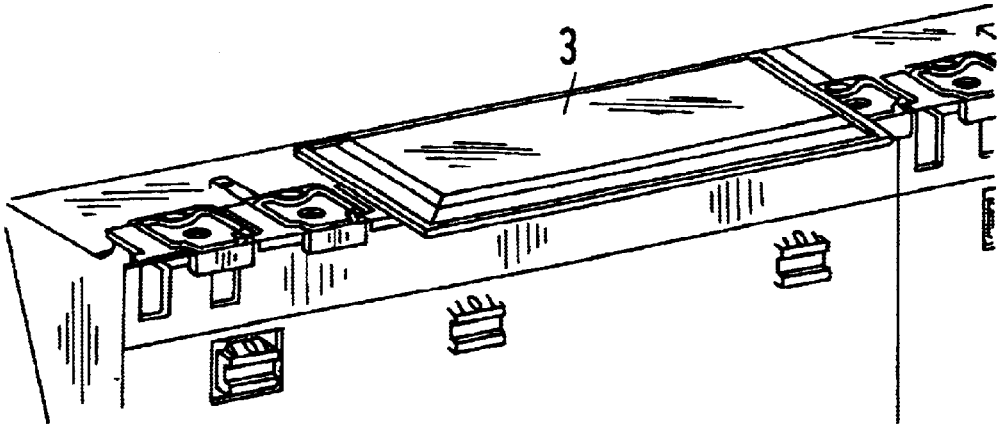
FIG. 21 is a perspective view of a wooden article secured on the embodiment of an advancing unit according to FIG. 20.

FIGS. 20 and 21 show the possibility of clamping reliably in the advancing unit 15 wide, sheet-like workpieces 3 by means of suction clamping devices. For this purpose, the upper clamping jaws 54 are moved downwardly (FIG. 20) so that all clamping jaws 54, 55 are at the same level.

The clamping jaws 54 are provided at their contact side with frame seals 102 (FIG. 20) which project in the lowered position of the clamping jaws past the lower clamping jaws 55. Moreover, the clamping jaws 54 are provided with at least one through opening 103. The wooden sheet article 3 (FIG. 21) is placed onto the clamping jaws 54, 55 wherein the projecting frame seals 102 rest cleanly on the support side of the wooden article 3. By means of the openings 103, vacuum is generated by which the wooden sheet article 3 is pulled tightly against the clamping jaws 54, 55 and is reliably secured. The clamping jaws 54 thus forms suction clamping devices which are connected in the manner known in the art to a vacuum system.

In the described embodiments, the upper and lower clamping jaws 54, 55 are staggered relative to one another. However, it is also possible to arrange not all of the clamping jaws 54, 55 so as to be staggered; instead, only some of these clamping jaws can be staggered. For example, the first upper and lower clamping jaws 54, 55 can be positioned precisely above one another while only the subsequently arranged clamping jaws 54, 55 are staggered. With such a configuration the wooden article 3 is safely and reliably clamped in the area of its end face for transverse machining. It is also possible to reliably clamp shorter wooden articles 3 in this way.

While specific embodiments of the invention have been shown and described in detail to illustrate the inventive principles, it will be understood that the invention may be embodied otherwise without departing from such principles.

What is claimed is:

1. A machine for machining workpieces (3) of wood or plastic material, the machine comprising:

at least one longitudinal profiling unit (2) comprising at least one longitudinal profiling spindle;

at least one advancing unit (15) configured to move a workpiece (3) past the at least one longitudinal profiling unit (2);

wherein the at least one advancing unit (15) has upper clamping jaws (54) arranged above the workpiece (3) and lower clamping jaws (55) arranged below the workpiece (3) such that at least some of the upper clamping jaws (54) are staggered relative to the lower clamping jaws (55), when viewed in a plan view onto the advancing unit (15); and wherein a small free space is provided between the upper and lower clamping jaws (54, 55), when viewed in a plan view.

2. The machine according to claim 1, wherein the upper and lower clamping jaws (54, 55) are arranged in a row, respectively, on the at least one advancing unit (15).

3. The machine according to claim 1, further comprising a drive (53) acting on at least some of the upper clamping jaws (54) for adjusting the upper clamping jaws (54).

4. The machine according to claim 3, wherein the upper clamping jaws (54) are individually adjustable.

5. The machine according to claim 3, further comprising carriers (59) connected to the drive (53), wherein the upper clamping jaws (54) are positioned on the carriers (59), respectively.

6. The machine according to claim 3, wherein the drive (53) comprises lifting cylinders (56) configured to adjust the carriers (59).

7. The machine according to claim 1, further comprising at least one lifting cylinder (72) for adjusting the lower clamping jaws (55).

8. The machine according to claim 1, wherein the upper and lower clamping jaws (54, 55), viewed in a plan view, have a complementary contour shape.

9. The machine according to claim 1, wherein the at least one advancing unit (15) comprises stops (46) provided across a length of the at least one advancing unit (15), wherein a longitudinal side of the workpiece (3) rests against the stops (46).

10. The machine according to claim 9, further comprising at least one support (62) on which the stops (46) are supported.

11. The machine according to claim 10, wherein the at least one support (62) is adjustable transversely to a transport direction of the workpiece (3).

12. The machine according to claim 10, wherein the at least one support (62) is rake-shaped.

13. The machine according to claim 10, further comprising carriers (59) connected to the drive (53), wherein the upper clamping jaws (54) are positioned on the carriers (59), respectively, and wherein the carriers (59) project through the at least one support (62) of the stops (46).

14. The machine according to claim 9, wherein the stops (46) are moveable into a lowered position against a counter force.

15. The machine according to claim 14, wherein the stops (46) are positioned in a movement path of the upper clamping jaws (54).

16. The machine according to claim 15, wherein the stops (46) are moveable by the upper clamping jaws (54) into the lowered position.

17. The machine according to claim 1, wherein the advancing unit (15) has at least one carrier (47) movable along at least one guide (50, 51) of the machine.

18. The machine according to claim 1, further comprising at least one transverse profiling unit (1) arranged upstream of the longitudinal profiling unit (2) and at least one transfer unit (36) provided in a transfer area between the transverse profiling unit (1) and the longitudinal profiling unit (2).

19. The machine according to claim 18, wherein the transfer unit (36) has two guides (37, 38) positioned at a spacing one above the other.

20. The machine according to claim 19, wherein the guides (37, 38) are endless circulating belts.

21. The machine according to claim 19, wherein the at least one transfer unit (36) has support elements (39, 40) and wherein the guides (37, 38) are arranged on one of the support elements (39, 40), respectively.

22. The machine according to claim 21, wherein at least one of the support elements (39, 40) is adjustable relative to the other support element.

23. The machine according to claim 18, wherein the at least one transfer unit (36) is vertically adjustable relative to the advancing unit (15).

24. The machine according to claim 18, further comprising at least one intermediate clamping device (33) arranged in the transfer area between the transverse profiling unit (1) and the longitudinal profiling unit (2).

25. The machine according to claim 24, wherein the intermediate clamping device (33) has clamping jaws (34, 35).

26. The machine according to claim 18, wherein the transverse profiling unit (1) has at least one clamping device (4) for the workpieces (3).

27. The machine according to claim 26, wherein the clamping device (4) has an upper clamping jaw (26) and a lower clamping jaw (25).

28. The machine according to claim 27, wherein the lower clamping jaw (25) is pivotable about an axis (32) relative to the upper clamping jaw (26) into a release position.

29. The machine according to claim 27, wherein the lower clamping jaw (25) has a free end provided with at least one stop (31) for the workpiece (3).

30. The machine according to claim 26, further comprising a carriage (5) on which the clamping device (4) is supported.

31. The machine according to claim 26, wherein the clamping device (4) or at least the upper and lower clamping jaws (25, 26) of the clamping device are pivotable about a vertical axis (6).

32. The machine according to claim 26, wherein the clamping device (4) is adjustable transversely to a transport direction of the workpiece (3) in the transverse profiling unit (1).

33. The machine according to claim 18, further comprising at least one transport unit (77) configured to transport the workpieces (3) from the transfer unit (36) into the advancing unit (15).

34. The machine according to claim 33, wherein the at least one transport unit (77) is arranged in the transfer area between the transverse profiling unit (1) and the longitudinal profiling unit (2).

35. The machine according to claim 33, wherein the transport unit (77) comprises pressing jaws (79) positioned at a spacing relative to one another.

36. The machine according to claim 35, wherein the pressing jaws (79) have a curved contact side.

37. The machine according to claim 1, wherein the at least one longitudinal profiling unit (2) has at least two advancing units (15) correlated therewith, wherein the at least two advancing units (15) are arranged mirror-symmetrical to one another.

38. The machine according to claim 37, wherein the upper and lower clamping jaws (54, 55) are arranged on each one of the at least two advancing units (15), respectively.

39. The machine according to claim 38, wherein at least some of the upper and lower clamping jaws (54, 55) are staggered relative to one another with a small free space therebetween, when viewed in a plan view.

40. The machine according to claim 38, wherein the upper and lower clamping jaws (54, 55) of the at least two advancing units (15) are oriented against one another.

41. The machine according to claim 38, wherein the at least two advancing units (15) are arranged adjacent to one another in a transfer area (80) in which the upper and lower clamping jaws (54, 55) of the at least two advancing units (15) engage the same workpiece (3).

42. The machine according to claim 37, wherein the at least two advancing units (15) are positioned adjacent to one another in a transport direction of the workpieces (3).

43. The machine according to claim 37, further comprising a common machine part (81), wherein the at least two advancing units (15) are guided on the common frame part (81).

44. The machine according to claim 1, wherein the at least one advancing unit (15) comprises a drive configured as a CNC axis.

45. The machine according to claim 1, wherein the at least one advancing unit (15) comprises suction clamping devices (54) for clamping wide workpieces (3), 46.

46. The machine according claim 1, wherein the upper clamping jaws (54) form a part of the suction clamping devices.

47. A method for machining workpieces (3) in a machine, wherein the machine has at least one longitudinal profiling unit (2) with at least one longitudinal profiling spindle and at least one advancing unit (15) configured to move a workpiece (3) past the at least one longitudinal profiling unit (2), wherein the at least one advancing unit (15) has upper clamping jaws (54) arranged above the workpiece (3) and lower clamping jaws (55) arranged below the workpiece (3) such that at least some of the upper clamping jaws (54) are staggered relative to the lower clamping jaws (55), when viewed in a plan view onto the advancing unit (15), and wherein a small free space is provided between the upper and lower clamping jaws (54, 55), when viewed in a plan view, wherein the workpieces (3) are clamped in the at least one advancing unit (15) and transported together with the at least one advancing unit (15) through the machine; the method comprising the steps of:

clamping the workpieces (3) from above and below in the at least one advancing unit (15); and transferring the workpieces (3) between different machining actions while remaining clamped at all times during transfer.

48. The method according to claim 47, further comprising the step of machining the workpieces (3) on at least one longitudinal side.

49. The method according to claim 48, wherein the workpieces (3) during the step of machining of the at least one longitudinal side are drilled by at least one stationary drilling unit (16).

50. The method according to claim 47, further comprising the step of machining the workpieces (3), while clamped from above and from below by the at least one advancing unit (15), in a first pass through the machine on a first end face (86) and on a first longitudinal side and in a second pass through the machine on a second end face (96) and on a second longitudinal side.

51. The method according to claim 50, wherein the step of machining comprises the steps of:

returning the at least one advancing unit (15) into an initial position after completion of the first pass;

removing the workpiece (3) from the at least one advancing unit (15);

turning the workpiece (3) by 180°;

clamping the workpiece (3) again in the at least one advancing unit (15); and moving the at least one advancing unit (15) through the machine for performing the second pass.

52. The method the machine according to claim 50, wherein the step of machining comprises the steps of:

clamping the workpiece (3) in a first advancing unit (15);

moving the workpiece in the first advancing unit (15) through the machine for performing the first pass;

transferring the workpiece (3) onto a second advancing unit (15);

transporting the workpiece (3) on the second advancing unit (15) through the machine for performing the second pass.

53. The method according to claim 52, wherein the workpiece (3) always remains fixedly clamped during transfer from the first advancing unit to the second advancing unit (15).

54. The method according to claim 52, wherein the workpiece (3) is transported in the same transport direction (21) through the machine by the first and second advancing units (15).

55. The method according to claim 52, wherein the workpiece (3) is transported through the machine by the second advancing unit (15) in a transport direction opposite to a transport direction of the first advancing unit (15).

56. The method according to claim 47, wherein in the step of clamping the workpieces (3) are secured by suction.

* * * * *